US006012995A

United States Patent [19]

Martin

[11] Patent Number: 6,012,995

[45] **Date of Patent: *Jan. 11, 2000**

[54] SCOREKEEPING RACKET DEVICE WITH AUDIO AND VISUAL DISPLAY

[76] Inventor: Steven D. Martin, 628 Enos Ct., Santa Clara, Calif. 95051

[ * ] Notice: This patent is subject to a terminal disclaimer.

[21] Appl. No.: 08/837,531

[22] Filed: Apr. 21, 1997

[51] Int. Cl.[7] ..... G08B 23/00

[52] U.S. Cl. ..... 473/459; 340/323 R; 377/5; 364/411.1

[58] Field of Search ..... 473/459, 461, 473/463, 464, 71, 224, 407, 438, 446, 447, 451, 524; 273/371, 376; 463/47, 3, 4, 1; 364/411.1, 410.1; 340/323 R; 377/4, 5

[56] References Cited

U.S. PATENT DOCUMENTS

| | | | |
|---|---|---|---|
| 4,097,855 | 6/1978 | Salvo | 340/323 R |
| 4,237,372 | 12/1980 | Zevgolis et al. | 340/323 R |
| 4,491,954 | 1/1985 | Genuit | 340/323 R |
| 4,974,857 | 12/1990 | Beall et al. | 273/371 |
| 5,127,044 | 6/1992 | Bonito et al. | 364/411.1 |
| 5,134,565 | 7/1992 | Herbertz | 364/411.1 |
| 5,198,976 | 3/1993 | Form et al. | 364/410.1 |
| 5,553,861 | 9/1996 | Pan | 273/371 |

*Primary Examiner*—Michael O'Neill
*Attorney, Agent, or Firm*—The Kline Law Firm

[57] ABSTRACT

An automated scorekeeping device for racket and paddle sports. The device includes a voice recorder that is used to announce the score before each serve of the game. The device further includes optional visual displays. Actuating devices adapted to the equipment of the particular games are provided so that the players can easily operate the scorekeeper while participating in the game. The scorekeeper can be adjusted manually to correct mistakes, and can be used in multiple modes.

17 Claims, 28 Drawing Sheets

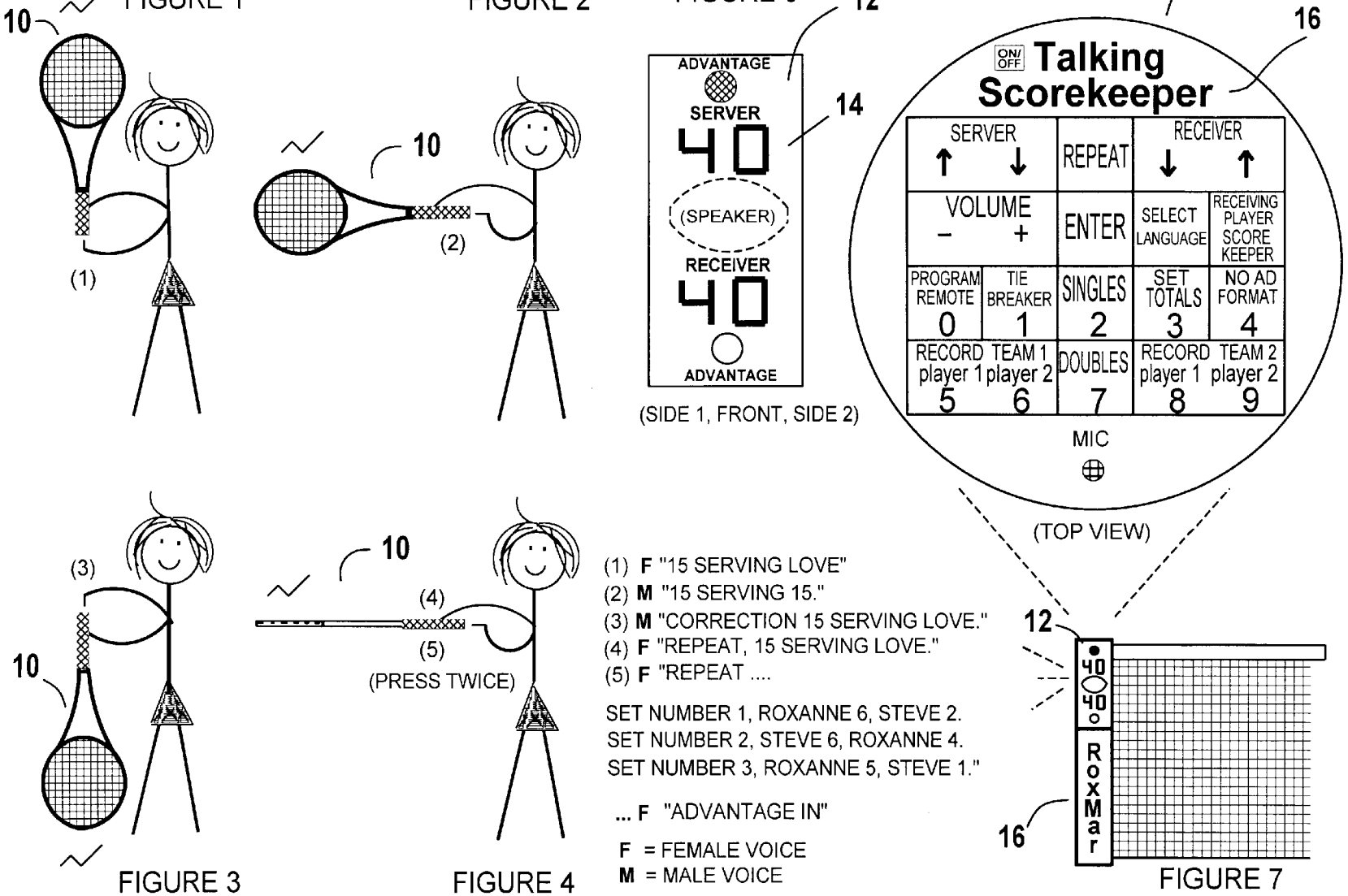
FIGURE 1
FIGURE 2
FIGURE 3
FIGURE 4
FIGURE 5
FIGURE 6
FIGURE 7
10
(1)
(2)
(3)
(4)
(5)
(PRESS TWICE)
12
14
16
18
ADVANTAGE
SERVER
40
(SPEAKER)
RECEIVER
40
ADVANTAGE
(SIDE 1, FRONT, SIDE 2)
ON/OFF
Talking
Scorekeeper
SERVER
REPEAT
RECEIVER
VOLUME
ENTER
SELECT LANGUAGE
RECEIVING PLAYER SCORE KEEPER
PROGRAM REMOTE 0
TIE BREAKER 1
SINGLES 2
SET TOTALS 3
NO AD FORMAT 4
RECORD TEAM 1 player 1 player 2 5
6
DOUBLES 7
RECORD TEAM 2 player 1 player 2 8
9
MIC
(TOP VIEW)
(1) F "15 SERVING LOVE"
(2) M "15 SERVING 15."
(3) M "CORRECTION 15 SERVING LOVE."
(4) F "REPEAT, 15 SERVING LOVE."
(5) F "REPEAT ....
SET NUMBER 1, ROXANNE 6, STEVE 2.
SET NUMBER 2, STEVE 6, ROXANNE 4.
SET NUMBER 3, ROXANNE 5, STEVE 1."
... F "ADVANTAGE IN"
F = FEMALE VOICE
M = MALE VOICE press 1
"repeat, love serving love"
* press 2
"you are the receiving player"
* press 2 before repeat score ends press 1
"repeat, love serving love"
* press 2
"you are the serving player"
* press 2 before repeat score ends press 1
"repeat, love serving love"
* press 2
"no advantage format enabled"
# rotate side up marked - NO AD
* press 2 before repeat score ends press 1
"repeat, love serving love"
* press 2
"tie breaker format enabled"
# rotate side up marked - TIE BREAKER.
* press 2 before repeat score ends
Note: Automatic disable after 1 game.

ADVANTAGE
SERVER
40
RoxMar
RECEIVER
40
ADVANTAGE
144
141
143
142
144
14
(SIDE 1, FRONT, SIDE 2)

18
124
ON/OFF
Talking
Scorekeeper
SERVER
REPEAT
RECEIVER
VOLUME
ENTER
SELECT LANGUAGE
RECEIVING PLAYER SCORE KEEPER
PROGRAM REMOTE
TIE BREAKER
SINGLES
SET TOTALS
NO AD FORMAT
RECORD TEAM 1 player 1 player 2
DOUBLES
RECORD TEAM 2 player 1 player 2
MIC
(TOP VIEW)
12
14
143
18

(Talking Scorekeeper figure 6)

(racket ball)

(badminton)

(tennis)

10"
109
40
30
NO AD
103
107
143
104
104
bottom view
REPEAT
SCORE
SCORE
REPEAT
racket side view
102

10"
102
108
103
107
143
109
104
104
bottom view
REPEAT
SCORE
SCORE
REPEAT
102
(Talking Racket)
(audio/visual)
(no transceiver)

10'
102
RECORD
PLAY
ERASE
PLAY
108
103
107
104
104
143
bottom view
REPEAT
SCORE
SCORE
REPEAT
ON
OFF
102
(Talking Racket)
(audio only)
(no transceiver)

10"
bottom view
201
201
201
201
REPEAT
SCORE
REPEAT
SCORE

10"
202
202
20

10"
TIE
BR
202
202
(side view)

10"
10'
109
NO AD
101
103
107
104
104
105
143
110
102
bottom view
racket side view
REPEAT
SCORE
108
(Talking Racket) (audio/visual)
(Talking Racket) (audio only)
RECORD
PLAY
ERASE
PROGRAM REMOTE
ON
OFF (Talking Tennis Racket)
(figures 13, 14, 14A, 15, 16, 16A)

TRUTH TABLE (S1 / racket position)

| P | A | B | C | S1 | | |
|---|---|---|---|---|---|---|
| 1 | 0 | 1 | 1 | 1 | = | self |
| 2 | X | 1 | 0 | 1 | = | opponent |
| 2 | X | 0 | 1 | 1 | = | opponent # |
| 3 | 1 | 0 | 0 | 1 | = | decrement |
| * | - | - | - | 1 | = | repeat score / set totals. |

P = racket position (racket face verticle)

* racket and racket face horizontal

* P 1-3 = false AND S1 = true

180 degree rotation

X = dont care

TRUTH TABLE S2 / racket position

| P | A | B | C | S2 | | |
|---|---|---|---|---|---|---|
| 1 | 0 | 1 | 1 | 1 | = | record |
| 2 | X | 1 | 0 | 1 | = | play |
| 2 | X | 0 | 1 | 1 | = | play # |
| 3 | 1 | 0 | 0 | 1 | = | erase |

# = 180 degree rotation

P = racket position (racket face vertical)

X = dont care (Talking Racket only)

FIGURE 20A

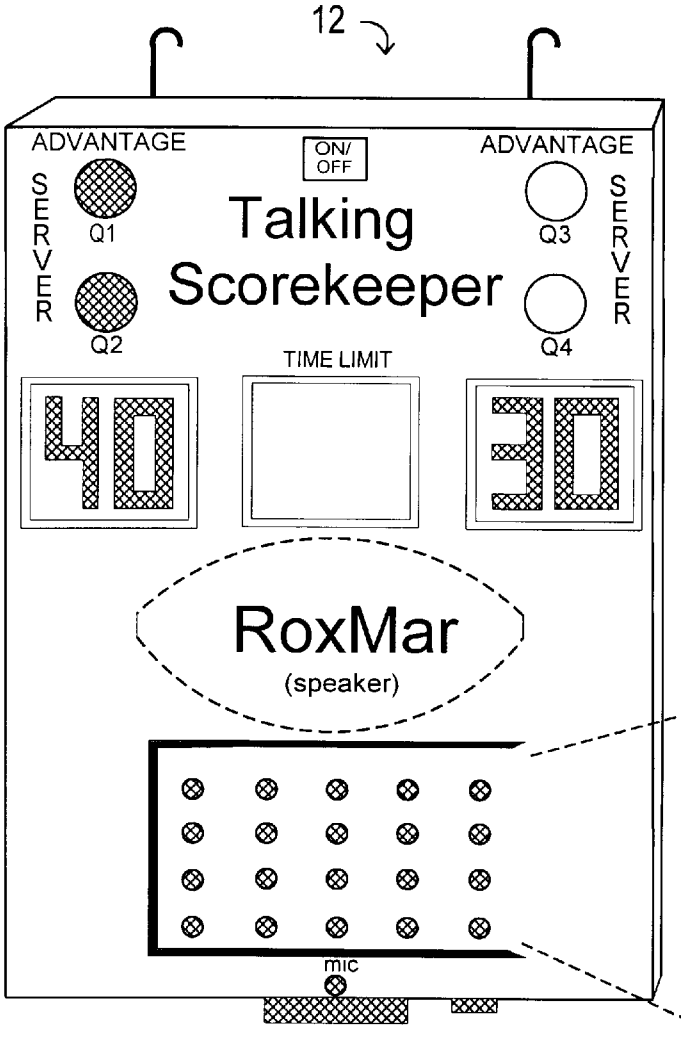

FIGURE 21

| PING PONG | | | | | 3 |
|---|---|---|---|---|---|
| ← | → | REPEAT | → | ← | |
| VOLUME – | VOLUME + | ENTER | SELECT LANGUAGE | SELECT GAME | |
| PROGRAM REMOTE 0 | SINGLES DOUBLES 1 | SERVER ↔ 2 | WIN TOTALS 3 | GAME POINT 4 | |
| RECORD player 1 5 | TEAM 1 player 2 6 | SCORE FORMAT 7 | RECORD player 1 8 | TEAM 2 player 2 9 | |

FIGURE 22

| VOLLEYBALL | | | | | 0/1 |
|---|---|---|---|---|---|
| ← | → | REPEAT | → | ← | |
| VOLUME – | VOLUME + | ENTER | SELECT LANGUAGE | SELECT GAME | |
| PROGRAM REMOTE 0 | RECORD TEAM 1 | LIST TEAMS 2 | SKIP TEAM 3 | GAME POINT 4 | |
| TIMER on/off 5 | SET TIMER 6 | TIMER STATUS 7 | QUICK SCORE 8 | SERVE MONITOR 9 | |

FIGURE 23

| TENNIS | | | | | 2 |
|---|---|---|---|---|---|
| ← | → | REPEAT | → | ← | |
| VOLUME – | VOLUME + | ENTER | SELECT LANGUAGE | SELECT GAME | |
| PROGRAM REMOTE 0 | TIE BREAKER 1 | SERVER ↔ 2 | SET TOTALS 3 | NO AD FORMAT 4 | |
| RECORD player 1 5 | TEAM 1 player 2 6 | SINGLES DOUBLES 7 | RECORD player 1 8 | TEAM 2 player 2 9 | |

FIGURE 24

| BASKET BALL | | | | | 4 |
|---|---|---|---|---|---|
| ← | → | REPEAT | → | ← | |
| VOLUME – | VOLUME + | ENTER | SELECT LANGUAGE | SELECT GAME | |
| PROGRAM REMOTE 0 | RESET QUARTER 1 | POINTS/ BASKET 2 | SHOT CLOCK 3 | GAME POINT 4 | |
| TIMER on/off 5 | SET TIMER 6 | TIMER STATUS 7 | RECORD TEAM 1 8 | RECORD TEAM 2 9 | |

FIGURE 25

| RACKET BALL | | | | | 5 |
|---|---|---|---|---|---|
| ← | → | REPEAT | → | ← | |
| VOLUME – | VOLUME + | ENTER | SELECT LANGUAGE | SELECT GAME | |
| PROGRAM REMOTE 0 | SINGLES 1 | DOUBLES 2 | CUT THROAT 3 | GAME POINT 4 | |
| RECORD player 1 5 | TEAM 1 player 2 6 | WIN TOTALS 7 | RECORD player 1 8 | TEAM 2 player 2 9 | |

FIGURE 26

| BADMINTON | | | | | 6 |
|---|---|---|---|---|---|
| ← | → | REPEAT | → | ← | |
| VOLUME – | VOLUME + | ENTER | SELECT LANGUAGE | SELECT GAME | |
| PROGRAM REMOTE 0 | SINGLES DOUBLES 1 | SERVER ↔ 2 | SERVE MONITOR 3 | GAME POINT 4 | |
| RECORD player 1 5 | TEAM 1 player 2 6 | WIN TOTALS 7 | RECORD player 1 8 | TEAM 2 player 2 9 | |

(racket motion generator)

FIGURE 29
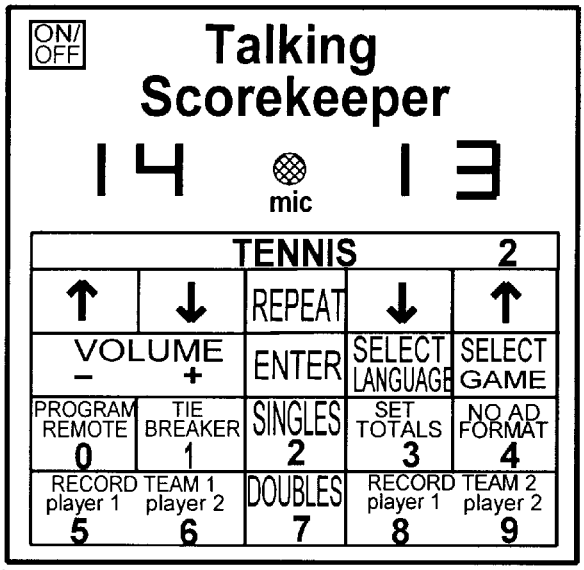
(top view)
FIGURE 30
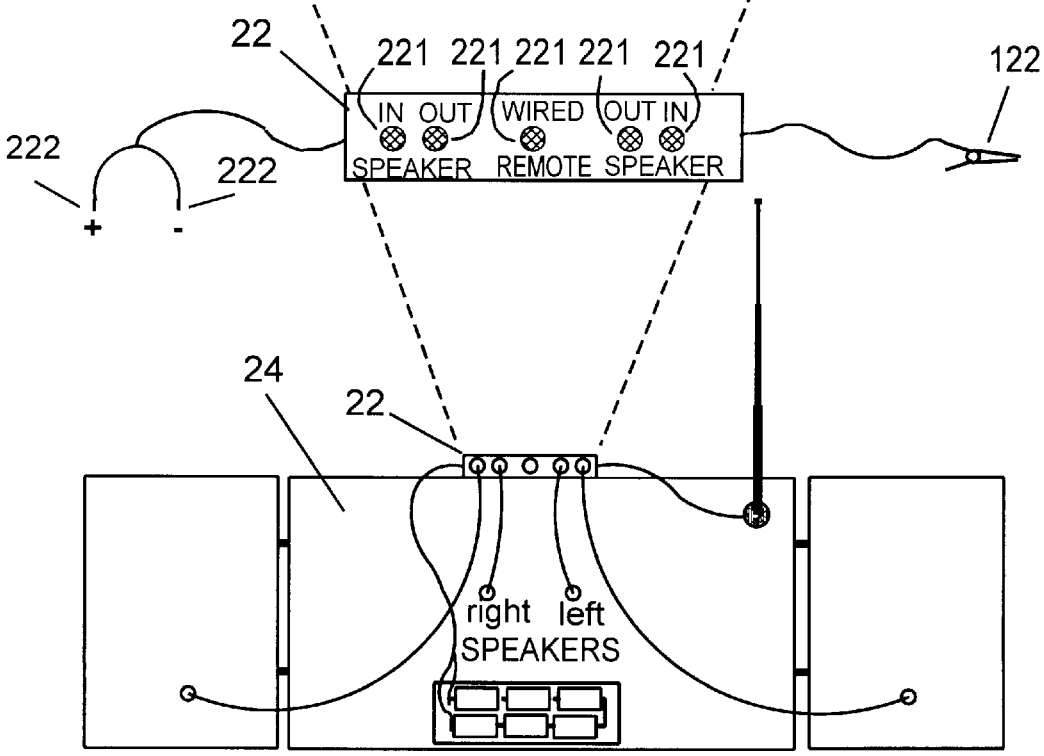
FIGURE 31
(Talking Scorekeeper and music)

FIGURE 33
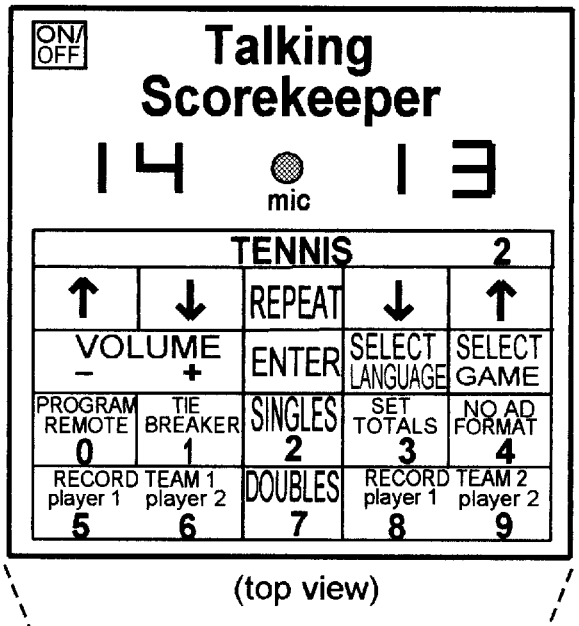
(top view)
FIGURE 34
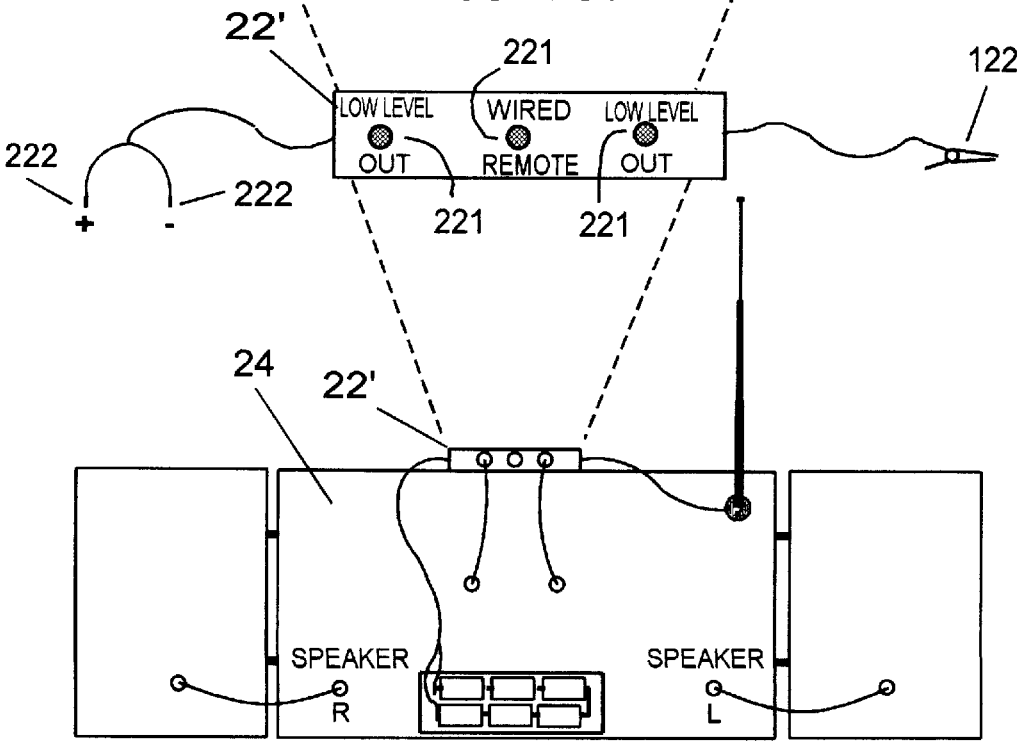
FIGURE 35
(Talking Scorekeeper, no music)

FIGURE 38
(audio only)
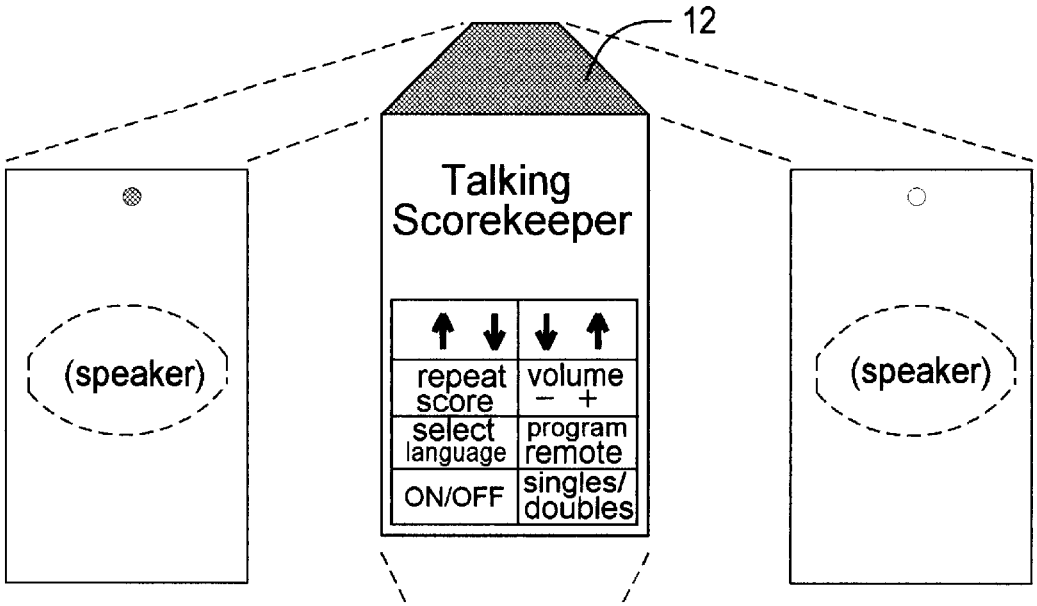
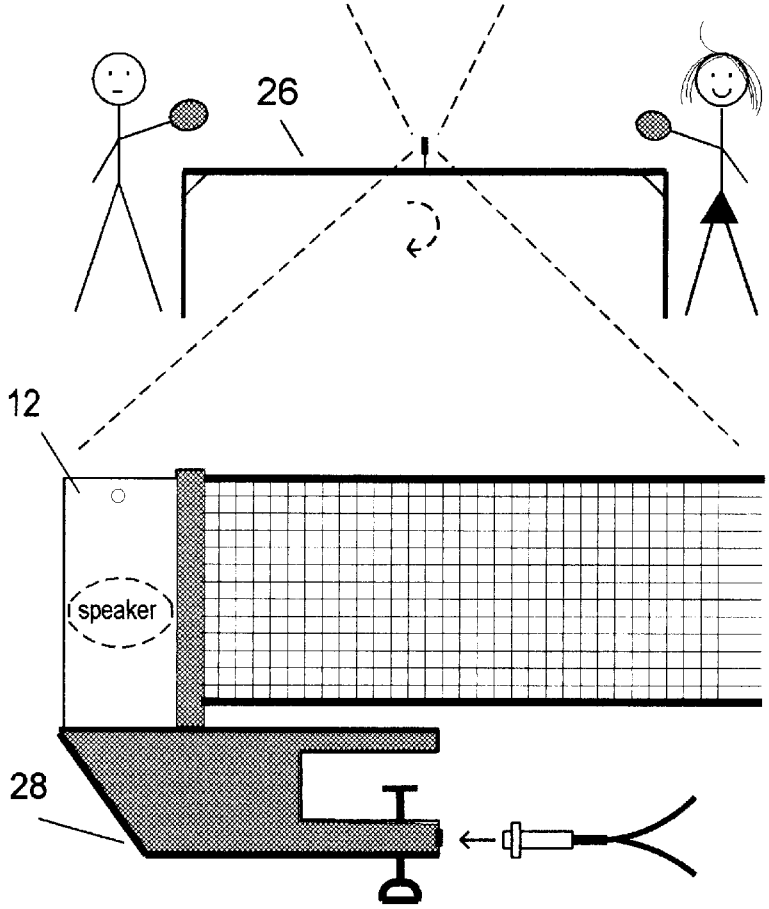
FIGURE 38A 325
323
32

322
324
(red)
(red)
SCORE
REPEAT
(white)
SCORE
(green)
(green)
(player 2)
(opponent)
326
(player 1)
(green)
RoxMar
SCORE
REPEAT
SCORE
(side 1)
(player 1)

324
322
32

323
325
(green)
(green)
SCORE
REPEAT
(white)
SCORE
(red)
(red)
(player 1)
(opponent)
326
(player 2)
(red)
RoxMar
SCORE
REPEAT
SCORE
(side 2)
(player 2)

(top view)

SCOREKEEPING RACKET DEVICE WITH AUDIO AND VISUAL DISPLAY

FIELD OF THE INVENTION

The present invention relates generally to scorekeeping devices, and more particularly is a "talking scorekeeper" for racket and paddle sports. This invention relates generally to Applicant's prior talking scorekeeper for volleyball as disclosed in U.S. Pat. No. 5,574,422, issued Nov. 12, 1996, which is hereby incorporated in its entirety.

BACKGROUND OF THE INVENTION

Racket and paddle sports have huge numbers of recreational participants. Some of the more popular racket and paddle sports include tennis, racquetball, badminton, ping pong, etc.

A common problem encountered by recreational players is losing track of the score. Since there is generally no non-participating scorekeeper, the players themselves have to also track the score. This can lead to many problems, given that the players chief focal point is on the playing of the points themselves. Although players are generally required to announce the score before each serve, confusion can be generated in long rallies, when changing servers, or simply in the course of the game itself. In addition to honest mistakes in the actual score of a game, a less than sportsmanlike player may intentionally misstate the score.

Disagreements in the score are a common cause of discord in recreational paddle and racket games, and can easily lead to arguments and decreased enjoyment of the game. In the worst case, games may be cancelled because of these disagreements.

Because of the expense of having an impartial scorekeeper, that solution is rarely if ever available to the recreational player. Inexpensive score displays are available, but the same problems with confusion of score can arise with these manual devices. It is simply too inconvenient for a player to periodically interrupt the game to update a scoreboard. Similarly, to date there has been no available automated device that has a selling price low enough to make it readily available to the pickup player.

The problem of tracking the score has been addressed by the inventor relative to other sports, e.g. volleyball, in U.S. Pat. No. 5,574,422, the "MULTI-FUNCTIONAL VOLLEYBALL TALKING SCOREKEEPER", issued Nov. 12, 1996. However to date, there is no known equivalent solution for racket and paddle sports.

Accordingly, it is an object of the present invention to provide a means for automatically keeping score of various racket and paddle games.

It is another object of the present invention to provide a device that audibly announces the score before each serve so that errors and incorrect scoring is noticeable by all players.

It is a further object of the present invention to provide a device that allows play to be continuous.

It is a still further object of the present invention to provide a device that has multiple options to allow the user to update the score.

It is another object of the present invention to provide a means to accurately and easily track the score of a game.

SUMMARY OF THE INVENTION

The present invention is an automated scorekeeping device for racket and paddle sports. The device includes a voice recorder that is used to announce the score before each serve of the game. The device further includes optional visual displays. Actuating devices adapted to the equipment of the particular games are provided so that the players can easily operate the scorekeeper while participating in the game. The scorekeeper can be adjusted manually to correct mistakes, and can be used in multiple modes.

An advantage of the present invention is that, prior to each serve, the score is audibly announced so that all players can track the score without visual monitoring. This provides a means to assure accurate and honest control of the score, even when the players themselves are responsible for the scorekeeping.

Another advantage of the present invention is that the score of the game can be kept accurately without interrupting the flow of the game.

A further advantage of the present invention is that the scorekeeper is small, lightweight, and easily installed in existing equipment.

A still further advantage of the present invention is that it is inexpensive to manufacture.

Yet another advantage of the present invention is that it can be utilized by players of all skill levels, and can also be used in organized games by the officials.

These and other objects and advantages of the present invention will become apparent to those skilled in the art in view of the description of the best presently known mode of carrying out the invention as described herein and as illustrated in the drawings.

BRIEF DESCRIPTION OF THE DRAWINGS

FIG. 1 shows the positioning of the talking scorekeeper for tennis when scoring a point for the server.

FIG. 2 shows the deployment of the talking scorekeeper for tennis when scoring a point for the receiver.

FIG. 3 shows a user making a correction in the score with the talking scorekeeper for tennis.

FIG. 4 shows the user repeating the announcement of the score with the talking scorekeeper for tennis.

FIG. 20A shows the remote scoreboard of the talking scorekeeper with the function designation face plate removed.

FIG. 21 shows a function designation plate for ping pong.

FIG. 22 shows a function designation plate for volleyball.

FIG. 23 shows a function designation plate for tennis.

FIG. 24 shows a function designation plate for basketball.

FIG. 25 shows a function designation plate for racquetball.

FIG. 26 shows a function designation plate for badminton.

FIG. 29 shows a front view of the scoreboard.

FIG. 30 shows adapting means to connect the scoreboard to an external stereo.

FIG. 31 shows the scoreboard connected to an external stereo in such a manner as to retain the stereo functions.

FIG. 33 shows a front view of the scoreboard.

FIG. 34 shows adapting means to connect the scoreboard to external stereo speakers.

FIG. 35 shows the scoreboard connected to external speakers.

FIG. 38 shows a talking scorekeeper with visual display adapted for ping pong.

FIG. 38A is a detail view of the ping pong scorekeeper net bracket.

FIG. 39A shows the first player scoring grid in position on the ping pong table.

DETAILED DESCRIPTION OF THE INVENTION

Figure 4B:
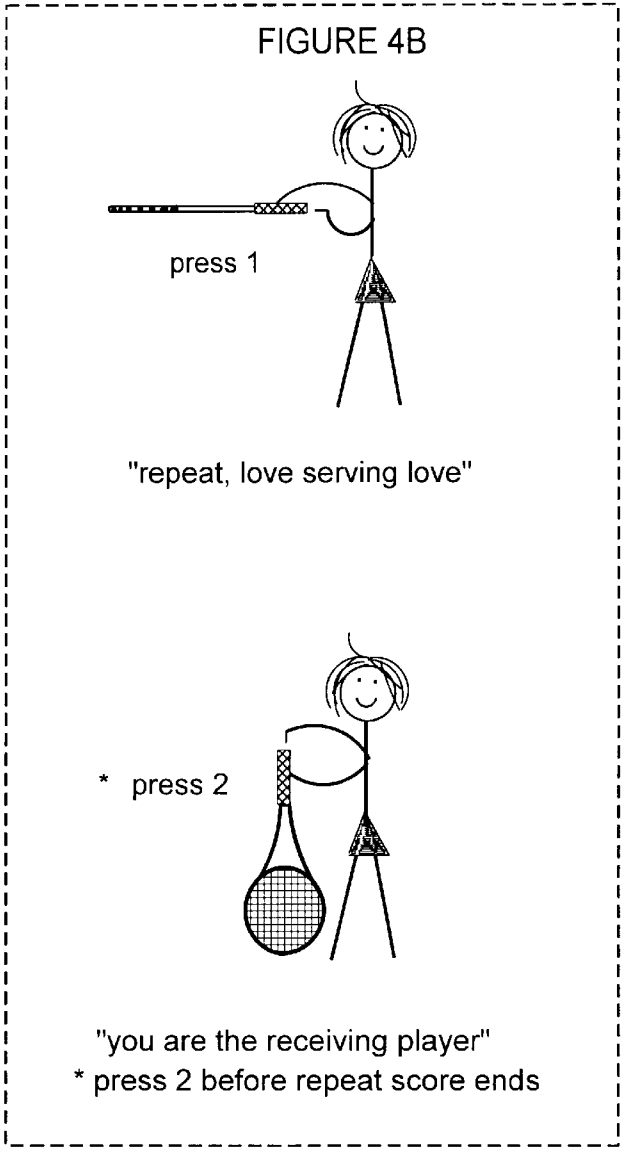
FIGS. 4A–D show the secondary functions activated by pressing the triggering means while the racket is in the repeat mode.
Figure 4A:
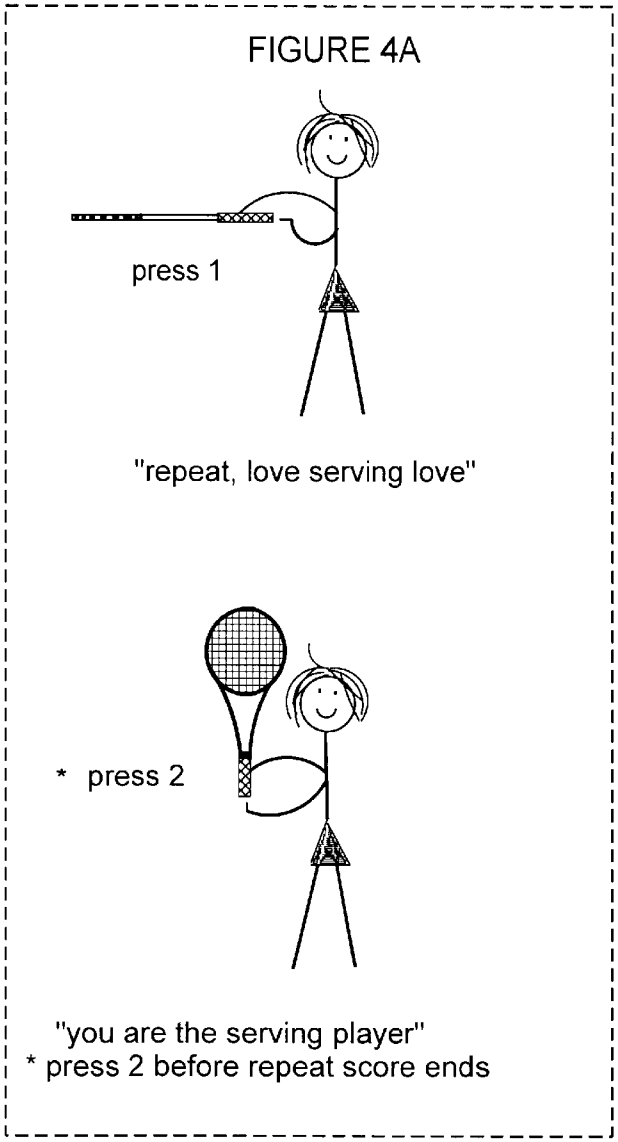
Figure 4D:
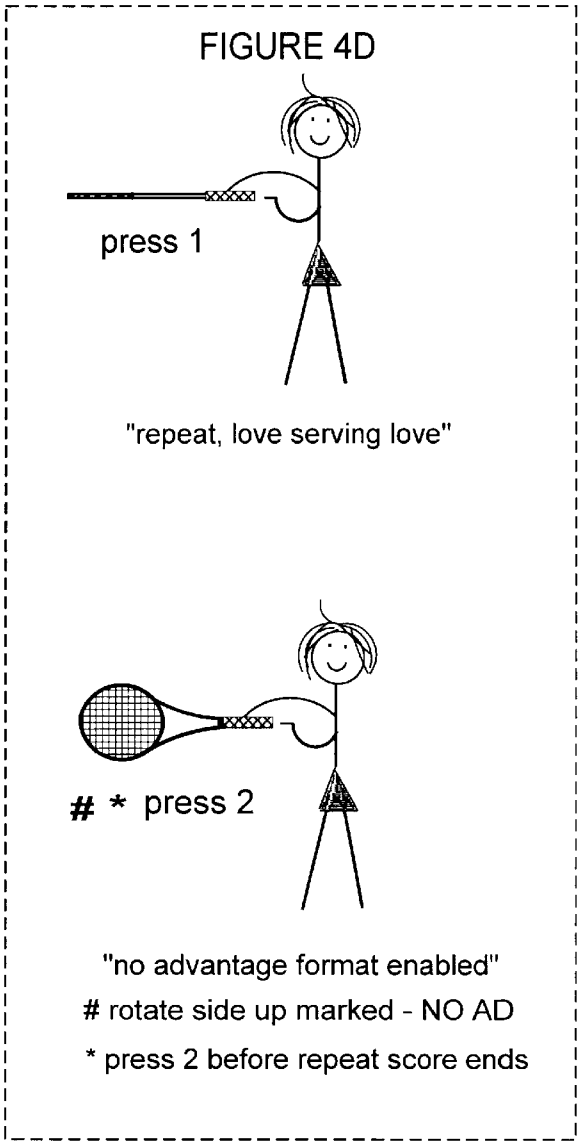
Figure 4C:
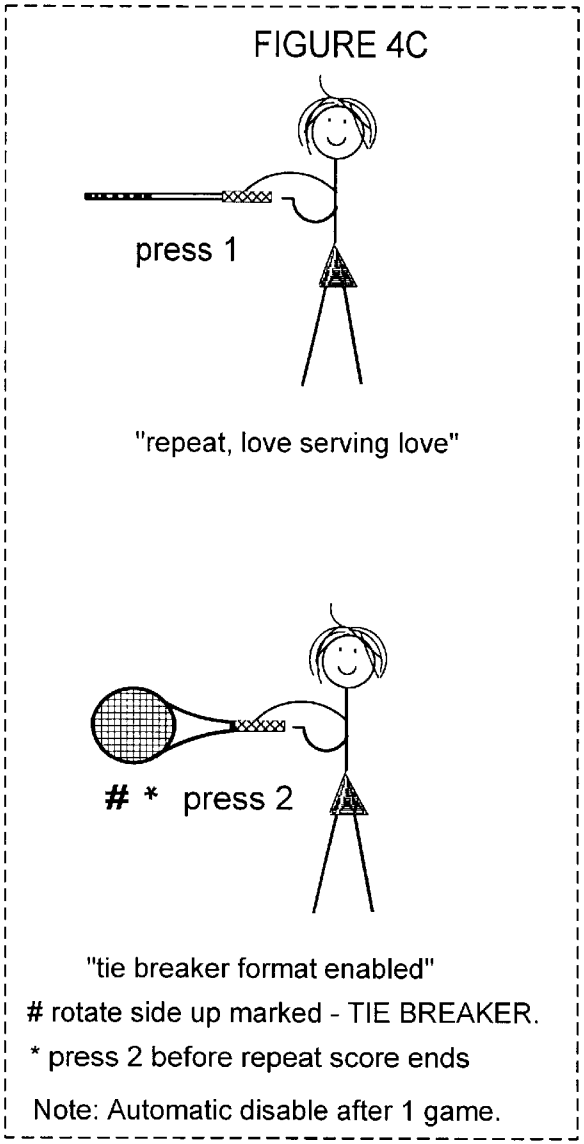

The present invention is a talking scorekeeper that is designed so that it can be adapted to many racket and paddle games. The first embodiment, addressed specifically in FIGS. 1–19, is directed to tennis. The talking scorekeeper includes means to provide a visual display of the score as well as an audio announcement of the score.

The talking scorekeeper for tennis includes a tennis racket 10 and a scoreboard 12. The racket 10 includes a remote control means 101 that is used to control the scoreboard 12. The scoreboard 12 includes a display 14 and a manual control panel 16.

The racket 10 includes orientation sensing means that trigger the scoring functions depending on the orientation of the racket 10 when the remote control means 101 is activated. In the preferred embodiment, when the racket 10 is pointed upward as in FIG. 1, the score for the server is incremented, displayed, and announced. When the racket 10 is extended toward the receiver with the racket face in a vertical orientation as in FIG. 2, the receiver's score is incremented, displayed, and announced. When the racket is pointed downward as in FIG. 3, an erroneous entry is deleted and the score decremented, displayed, and announced. Finally, when the racket is extended with the racket face in a horizontal alignment as in FIG. 4, and the triggering means 102 of the remote 101 is activated, the current score is repeated. If the triggering means is activated twice in rapid succession, the score for the entire playing session to that point is announced. If the racket is rotated to other positions while the repeat announcement is being played, the functions illustrated in FIGS. 4A–D are accomplished. Pointing the racket upward announces the server, downward announces the receiver. While the power on default is the server updating the score, the racket can be programmed so that the receiver keeps score. Rotating the racket 90° in a first direction initiates the tie breaker format scoring, and rotating the racket in a second direction initiates no ad scoring.

Figure 18:
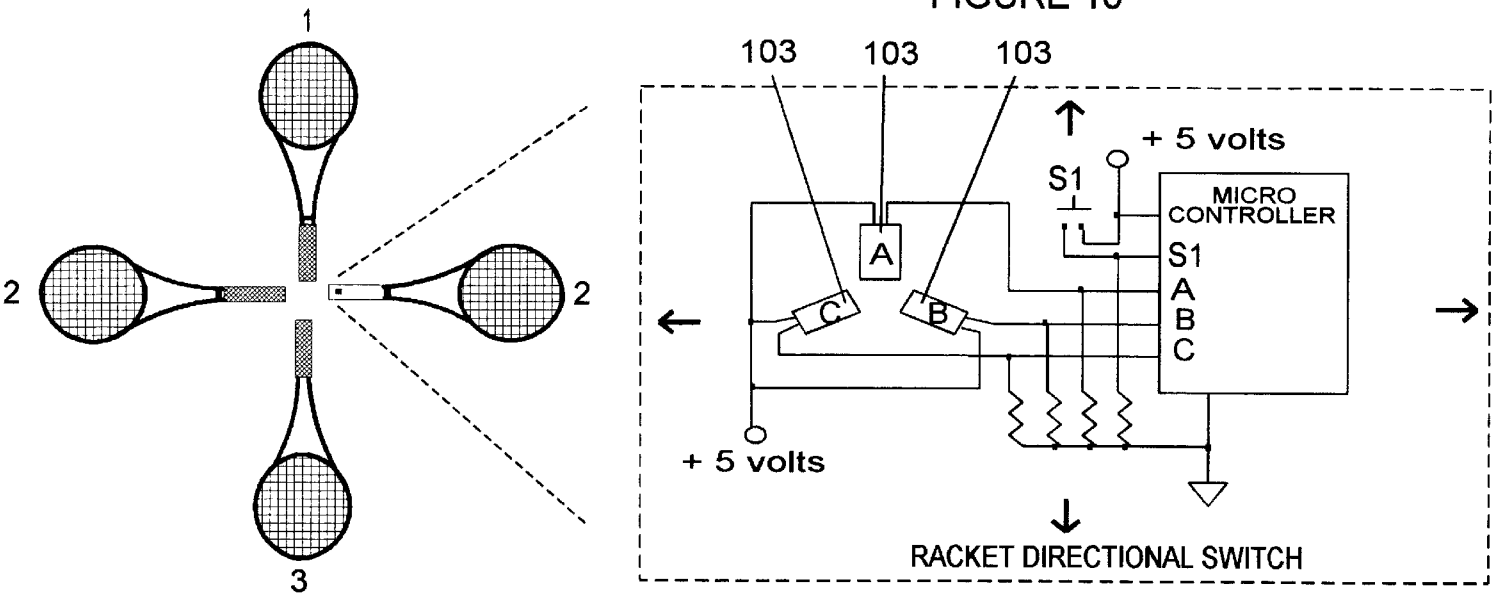
FIG. 18 illustrates the operation of the talking racket first directional switch.

The racket 10 accomplishes these scorekeeping functions by means of a racket directional sensing means 103 located in the handle of the racket 10. In the preferred embodiment, the directional sensing means 103 is a plurality of mercury switches, as illustrated in FIG. 18. The arrangement of the mercury switches allows the racket 10 to determine which direction the user is pointing the racket 10. The truth table for the directional sensing means 103 is illustrated in FIG. 18.

Figure 9:
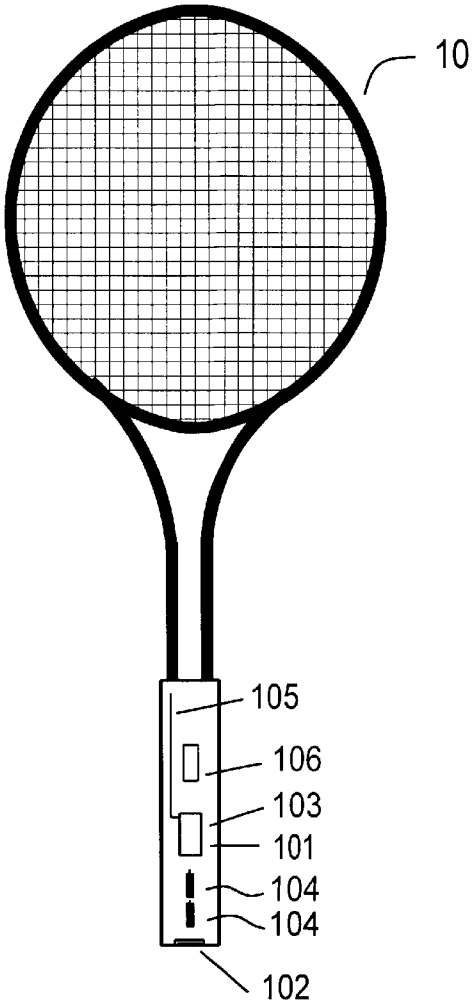
FIG. 9 shows a tennis racket used with the talking scorekeeper.
Figure 12:
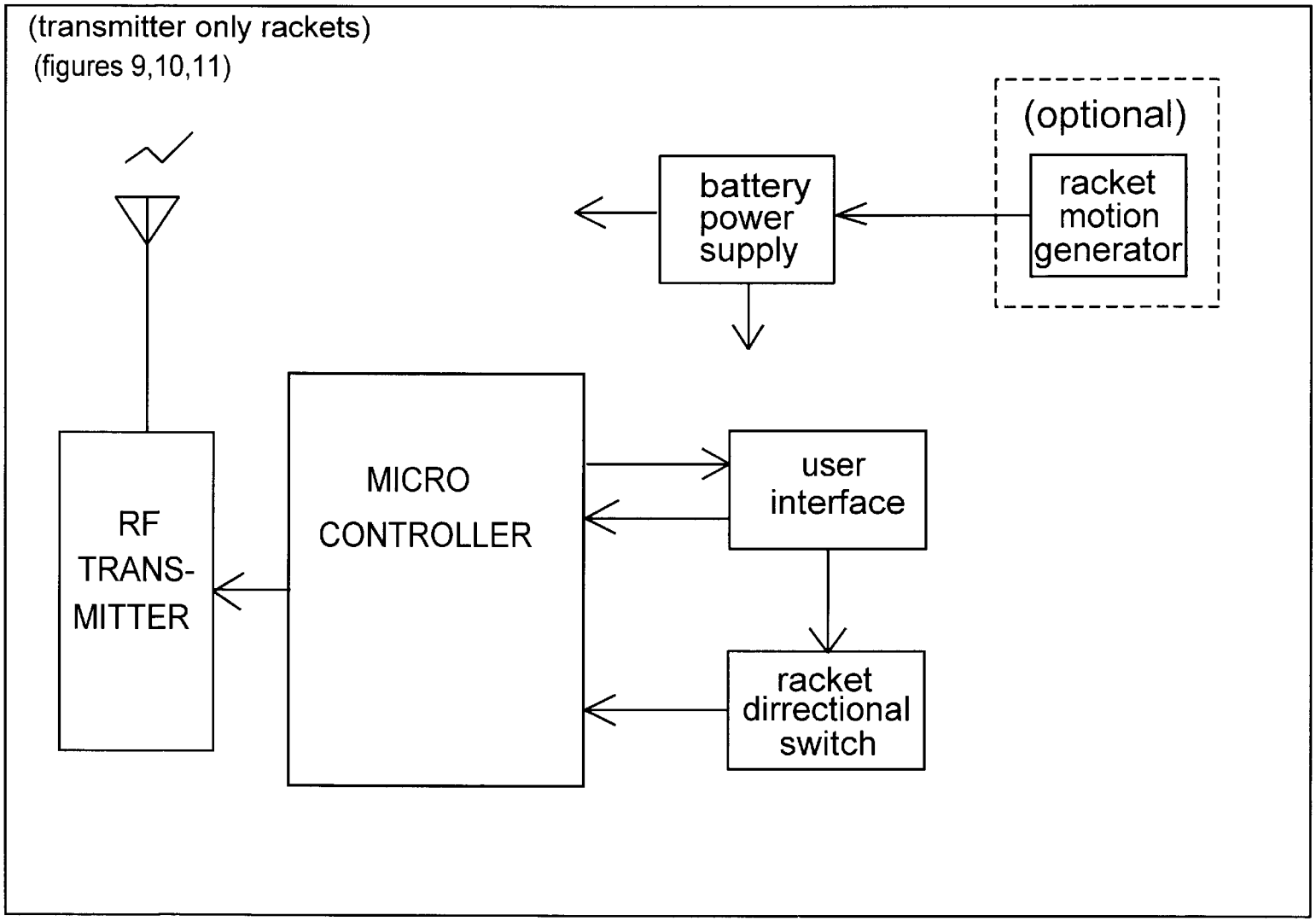
FIG. 12 is a schematic diagram of the circuitry of the racket of the talking scorekeeper.

FIG. 9 shows the physical construction of the tennis racket 10. Power is supplied by batteries 104 in the handle of the racket 10. No on/off switch is required as the standby current is at 0 when no RF signal is being transmitted. A recessed push button, generally installed in the base of the racket handle, serves as the primary triggering means 102. A transmitter or transceiver (combined transmitter and receiver) 101 allows the racket 10 to communicate with other rackets 10 or with the scoreboard 12. Some form of antenna 105 is required for transmission. FIG. 12 is a schematic diagram of the circuitry of the racket 10.

When a first racket 10 communicates with a second racket 10, a short duration coded signal is used to establish the link between the rackets. The signal updates the microcontroller of the second racket 10 with the current score. The second racket 10 then announces the score through its voice chip 107. These short duration signals require the racket 10 to have far less battery capacity than would for instance a full duration, RF modulated audio score from the transmitting racket.

Also, because of the low number of components and the use of very small SOIC components, the components required will easily fit into the handle of an existing racket. Therefore, retro-fifting existing rackets to give them "talking racket" capability is quite feasible.

Figure 28:
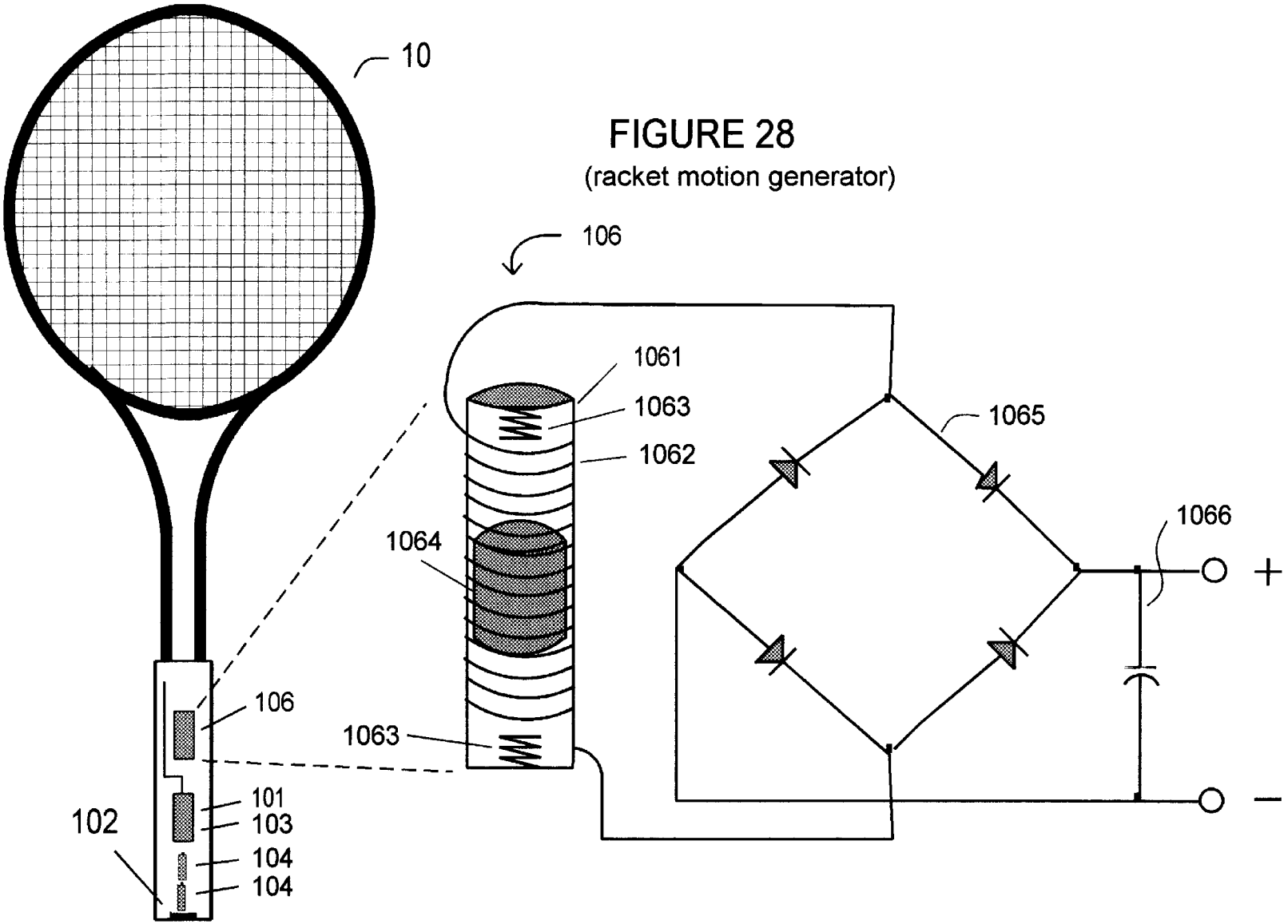
FIG. 28 illustrates a self-contained generator for the racket of the talking scorekeeper for tennis.

If desired, a motion operated generator 106 can be included to charge the batteries 104 in any of the rackets described herein. FIG. 28 illustrates one embodiment of the motion generator 106. The motion generator 106 includes a cylindrical sleeve 1061 with a coil 1062 wrapped around the sleeve 1061. A spring 1063 is affixed to each end of the interior of the sleeve 1061. A permanent magnet 1064 is contained within the sleeve 1061. An electric current is generated by the motion of the magnet 1064 within the sleeve 1061 through the coil 1062. The current is processed through a bridge rectifier 1065 and a filter capacitor 1066, and is then suitable to recharge the batteries of the scorekeeper.

Figures 5A, 6A, 7A:
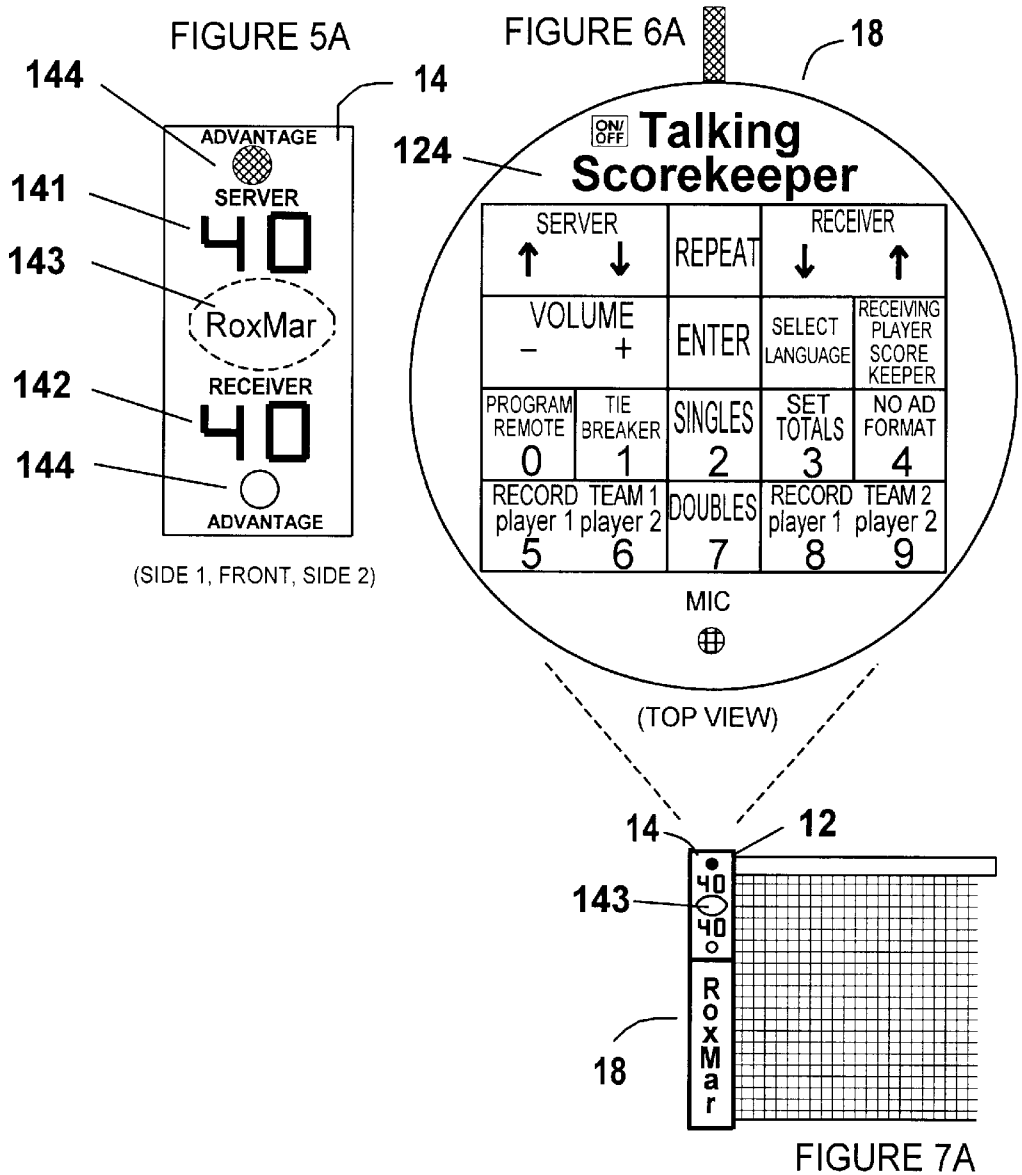
FIG. 5 shows the scoreboard for the talking scorekeeper for tennis.
FIG. 6 is an illustration of a manual control panel for the talking scorekeeper for tennis.
FIG. 7 shows the scoreboard of FIG. 5 installed on a net post.

The scoreboard 12 includes a display 14 as shown in FIG. 5. The display 14 includes a server score display 141, a receiver score display 142, a speaker 143, and a means 144 to indicate which player has the advantage following a deuce point. The speaker 143 is used to audibly announce the score.

The display 14 can also be operated by the manual control panel 16 illustrated in FIG. 6. The manual control panel 16 will generally only be used during play if a non-participant is keeping score. In addition to the scoring functions, which function in the same manner as those controlled by the remote 101, the manual control panel 16 includes a volume control and a language select function if the voice chip is programmed in more than one language.

As shown in FIG. 7, the scoreboard 12 can be manufactured as an integral part of a net post 18. In this configuration, the scoreboard would include front and back (the surfaces parallel to the net 20) displays so that both the players can easily see and hear the score. In addition, the scoreboard can optionally include a display with speaker mounted on the side of the net post 18 for the convenience of an audience.

Figure 8:
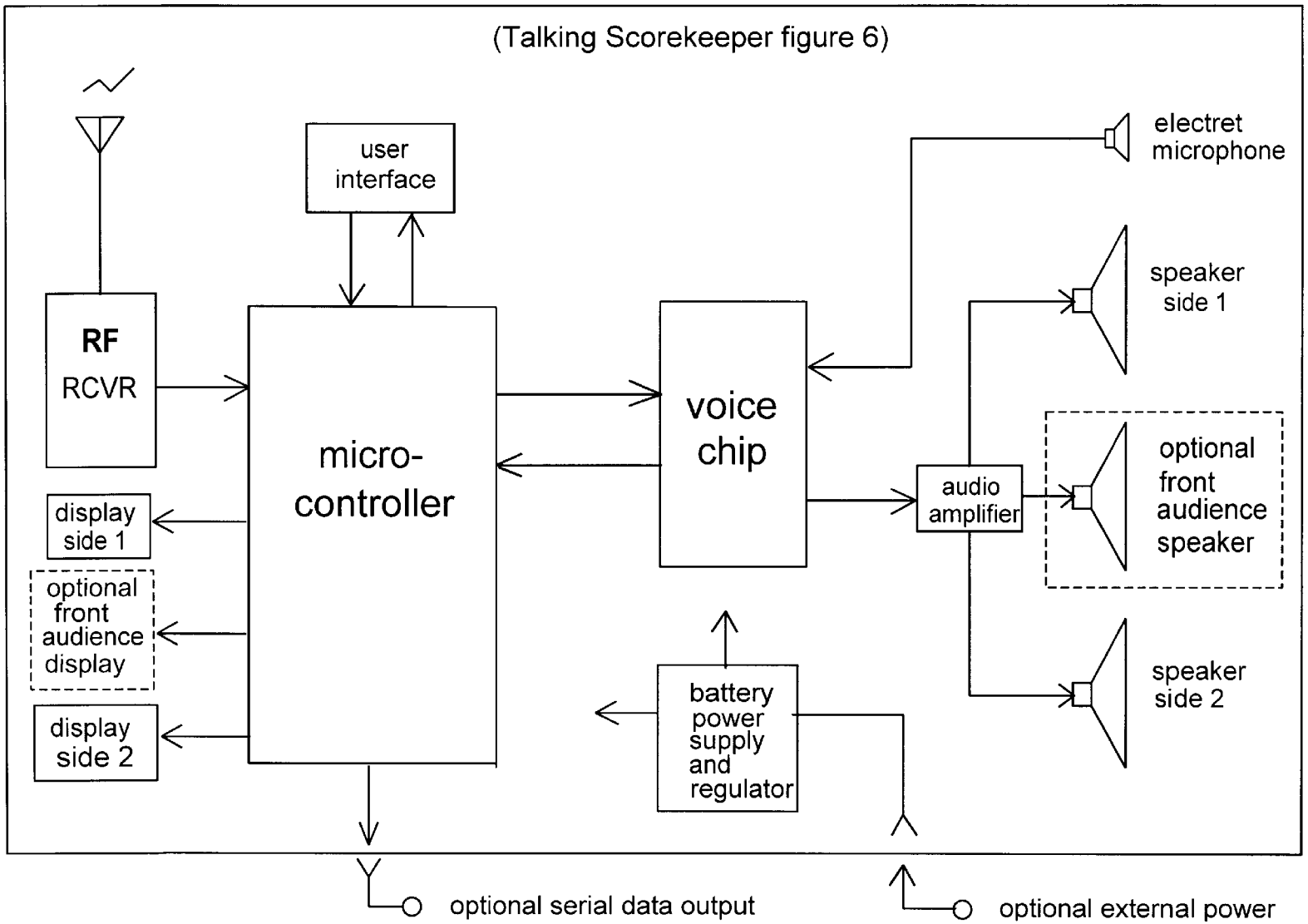
FIG. 8 is a schematic diagram illustrating operation of the talking scorekeeper scoreboard.
Figure 11:
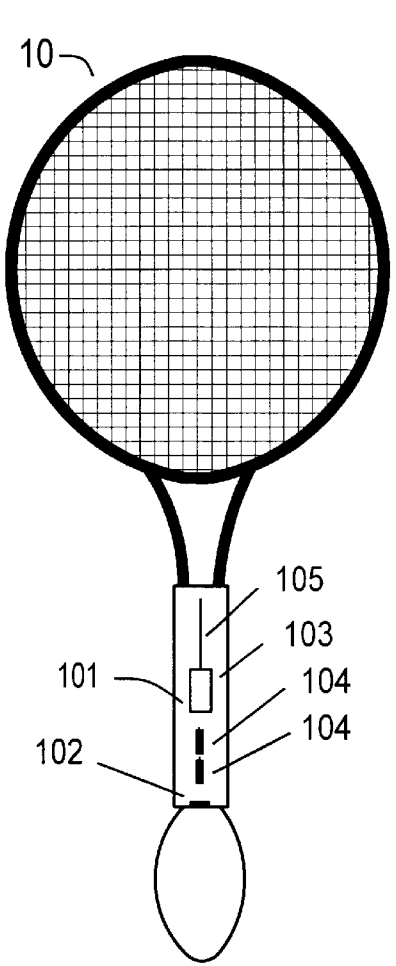
FIG. 11 depicts a racquetball racket used with the talking scorekeeper.
Figure 10:
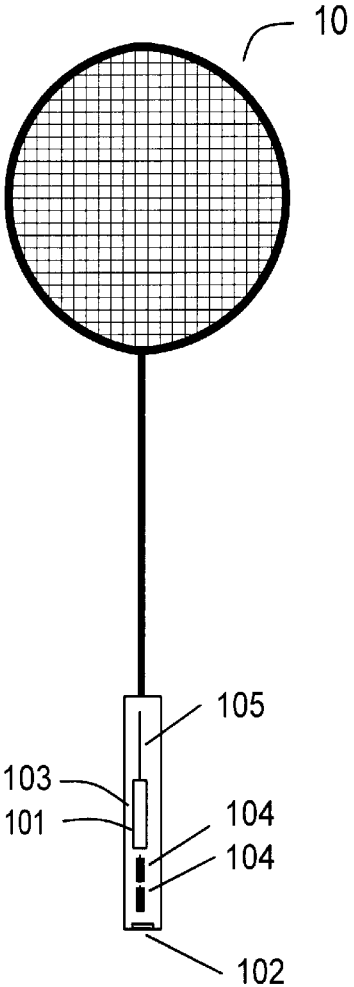
FIG. 10 illustrates a badminton racket used with the talking scorekeeper.

A schematic diagram of the circuitry of the scoreboard 12 is shown in FIG. 8. The microcontroller is controlled by either the remote 101 or the control panel 16. The microcontroller controls the display of the current score on the visual displays 14 of the scoreboard 12. For the audio portion of the scoring, an addressable voice chip is included. The voice chip activates the speakers. Generally, there will be at least two speakers installed in the scoreboard 12. The voice chip is pre-programmed to include all potential scores for both the server and the receiver. A first voice is used for the server's score and a second voice is used for the receiver's score so that there is no chance of mistaking whose score is being announced. For maximum distinguishing of the voices, a male voice and a female voice can be used.

Operation of the racket 10 as illustrated in FIGS. 1–4 is as follows: In FIG. 1, the server has won the first point, and therefore holds the racket upright and activates the triggering means, the push button 102. The scoreboard 12 display 14 will show "15" as the server's score, "0" as the receiver's score, and the audio portion will announce "fifteen love".

When the server depresses the push button 102 with the racket as shown in FIG. 2, the scoreboard will display "15" as both players'score, and will announce audibly "fifteen all" or "fifteen fifteen".

If a mistake is made in the scoring, the user holds the racket as shown in FIG. 3 and activates the push button 102. This will erase the last point entered, and the scoreboard display will be adjusted appropriately, and the new score will be announced. Correction can be repeated as many times as is required. That is, if two points were entered incorrectly, the erase function can be triggered twice. The proper scoring is then input.

To repeat the current score, the racket 10 is positioned as shown in FIG. 4. When the push button 102 is pushed, the current score is audibly announced. If the push button 102 is pushed twice while the racket 10 is in this position, the scoreboard 12 will announce all results for the day, the current score, as well as the scores of any sets played previously in the session. As play continues, the talking scorekeeper continues to update and compile the scoring.

The manual control panel includes a plurality of control buttons 161. In addition to the scoring functions described above, there is a "SELECT LANGUAGE" button that allows multiple languages to be used in the talking scorekeeper. The power on default is the last language used on the machine.

A "RECEIVING PLAYER SCORE KEEPER" button is used if only one of the players has a transmitting racket 10. The power on default mode of the machine is that the server will always update the score. If the "RECEIVING PLAYER SCORE KEEPER" button is activated at the start of play, the talking scorekeeper is alerted that only one player will be keeping score, and adjusts the data entry accordingly.

The "PROGRAM REMOTE" function allows transmitter codes to be stored in the talking scorekeeper to allow remote access.

There are also functions included in the talking scorekeeper to allow players to specify singles or double, what type of scoring is to be used (no add, tiebreakers, etc.), and even the players names to personalize the audio announcements.

Figures 13, 14, 14A:
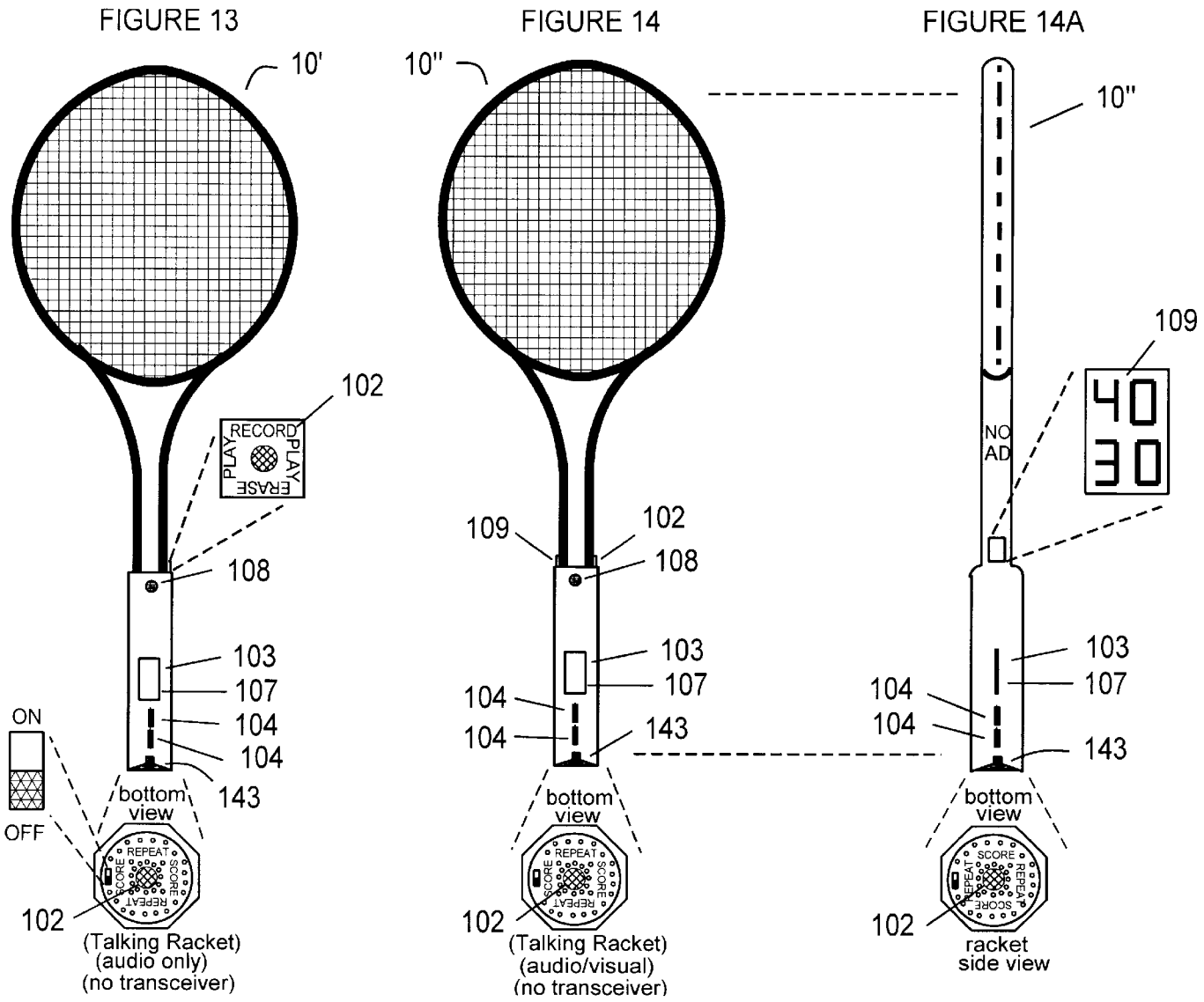
FIG. 13 shows the physical layout of a tennis racket with self-contained audio scoring.
FIG. 14 shows the physical layout of a racket for a self-contained talking scorekeeper for tennis with both audio and visual scoring.
FIG. 14A is a side view of the device illustrated in FIG. 14.
Figure 19:
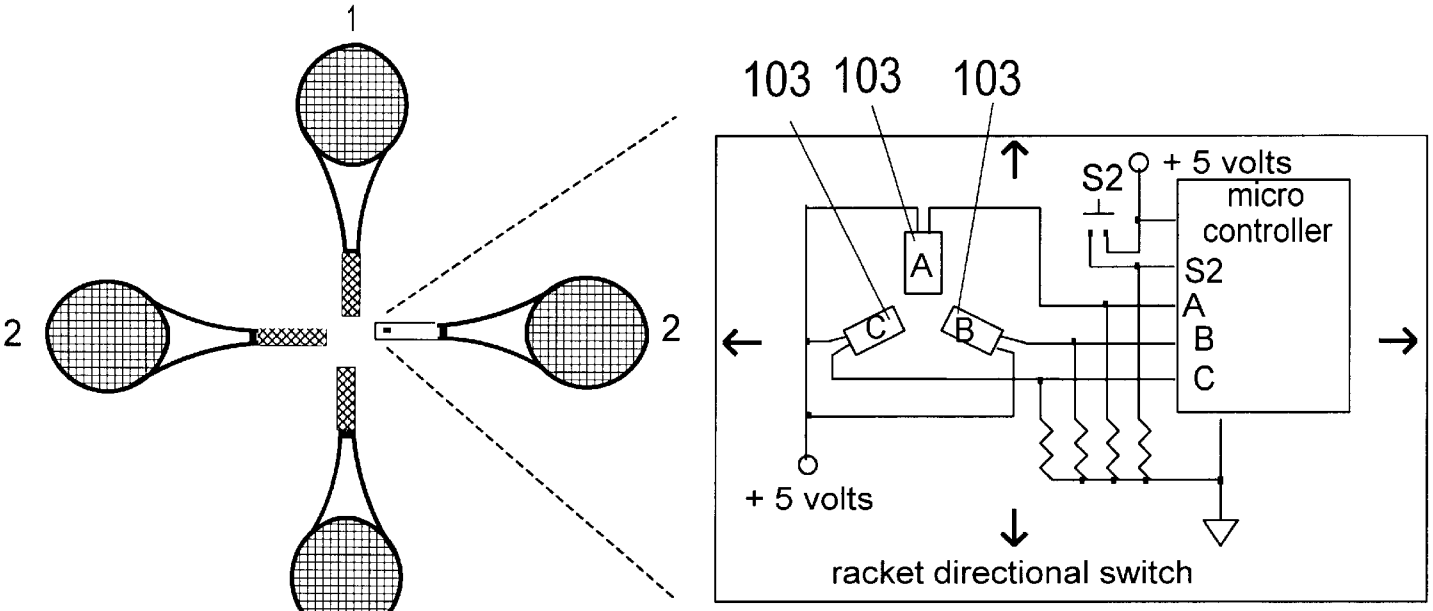
FIG. 19 illustrates the operation of the talking racket second directional switch.

FIG. 13 illustrates a second configuration of the racket, a talking racket 10'. This racket includes a built-in voice chip 107 that announces the score through a speaker 108 in the base of the racket handle. The butt cap plate is labelled to remind the user of the racket orientation to accomplish the various scoring activities. The talking racket 10' may optionally include a microphone 108 and a second triggering means 102 located at the top of the racket handle to provide for data input functions as illustrated in FIG. 19. This triggering means 102 is also labelled to remind the user of proper orientation. The talking racket 10' is a self-contained unit that announces the score without the necessity of an independent scoreboard 12.

Figures 15, 16, 16A:
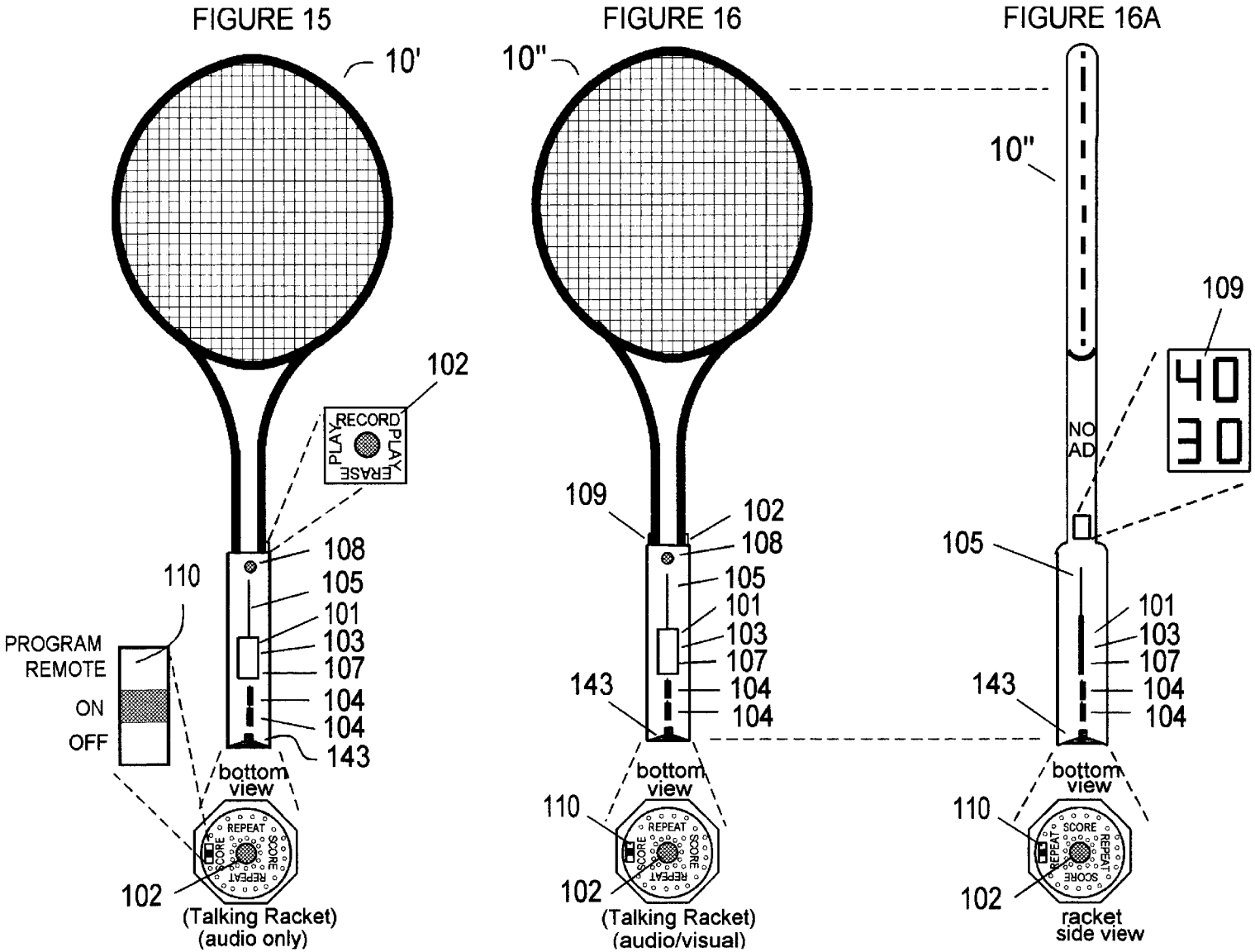
FIG. 15 shows the physical layout of a talking scorekeeper for tennis with audio scoring only and with remote capability.
FIG. 16 shows the physical layout of a talking scorekeeper for tennis with both audio and visual scoring and with remote capability.
FIG. 16A is a side view of the device illustrated in FIG. 16.
Figure 17:
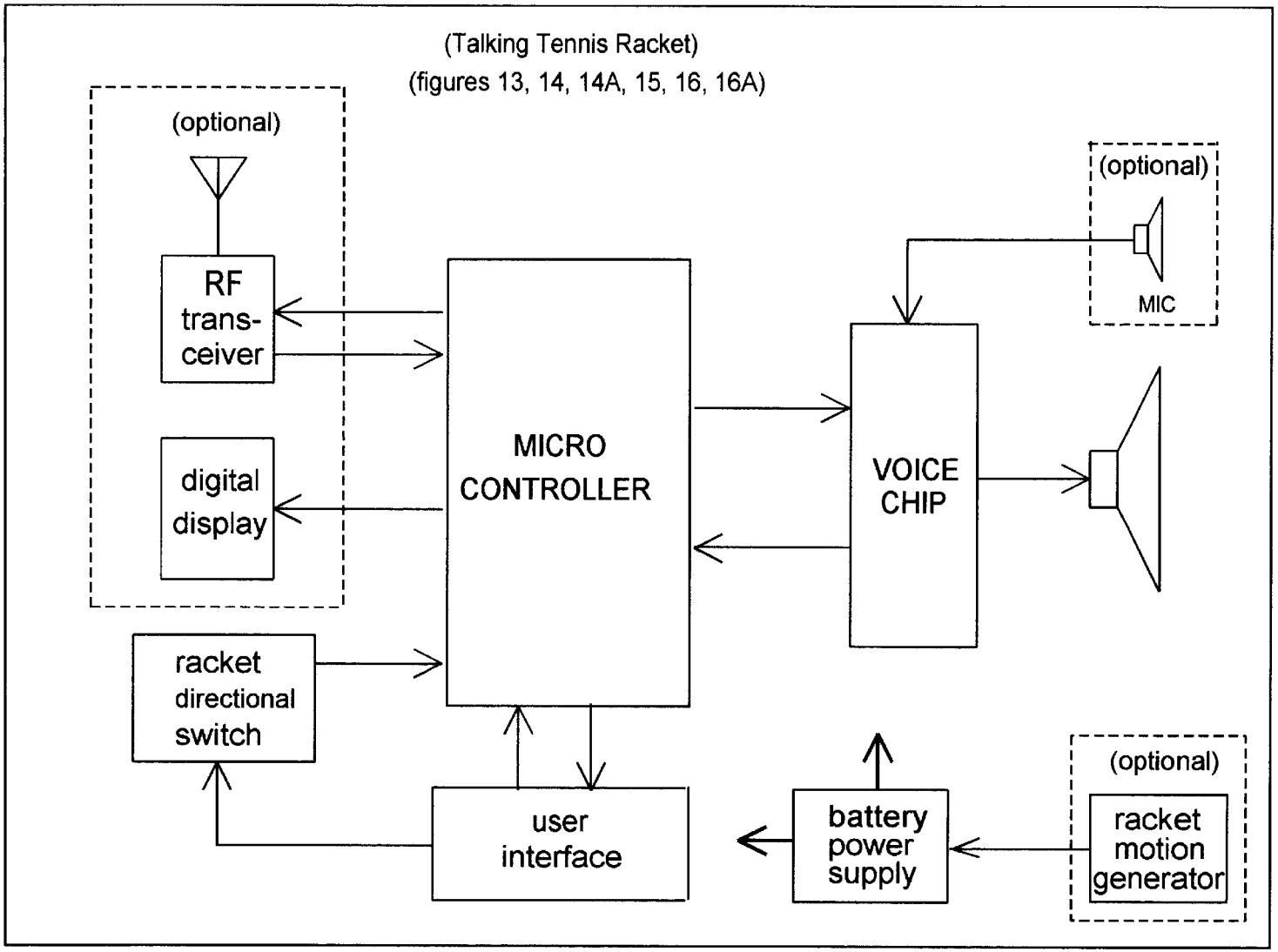
FIG. 17 is a schematic diagram of the talking tennis racket of the present invention.

FIGS. 14 and 14A show a talking racket 10" that includes a visual display as well as the audio announcement. The only additional component required is a small digital display 109 that is mounted on the racket 10". FIGS. 15, 16, and 16A demonstrate talking rackets 10' and 10" that include means to communicate with an opponent's racket or with a remote scoreboard 12. This embodiment requires only the addition of a transceiver 101 and a three-position switch 110. The scoring and programming functions remain unchanged, but the "PROGRAM REMOTE" function allows the scoreboard 12 to be activated. When two talking rackets are being used, the RF signal transceiver codes for each racket are entered the other racket. The codes are entered by setting a first racket switch 110 to the program position. The second racket's transmitter button is activated for approximately one second. The above is repeated to enter the code for the other racket. The codes are retained even after the power is turned off.

FIG. 18 shows the racket 10', 10" position, directional sensing means 103, and the truth table for the rackets. The talking rackets 10', 10" function in the same manner as the transmit only racket 10. FIG. 19 is an equivalent illustration of the programming means controlled by the second motion sensing means. These functions are for initialization of the scorekeeper only.

Figures 14B, 14C, 14D:
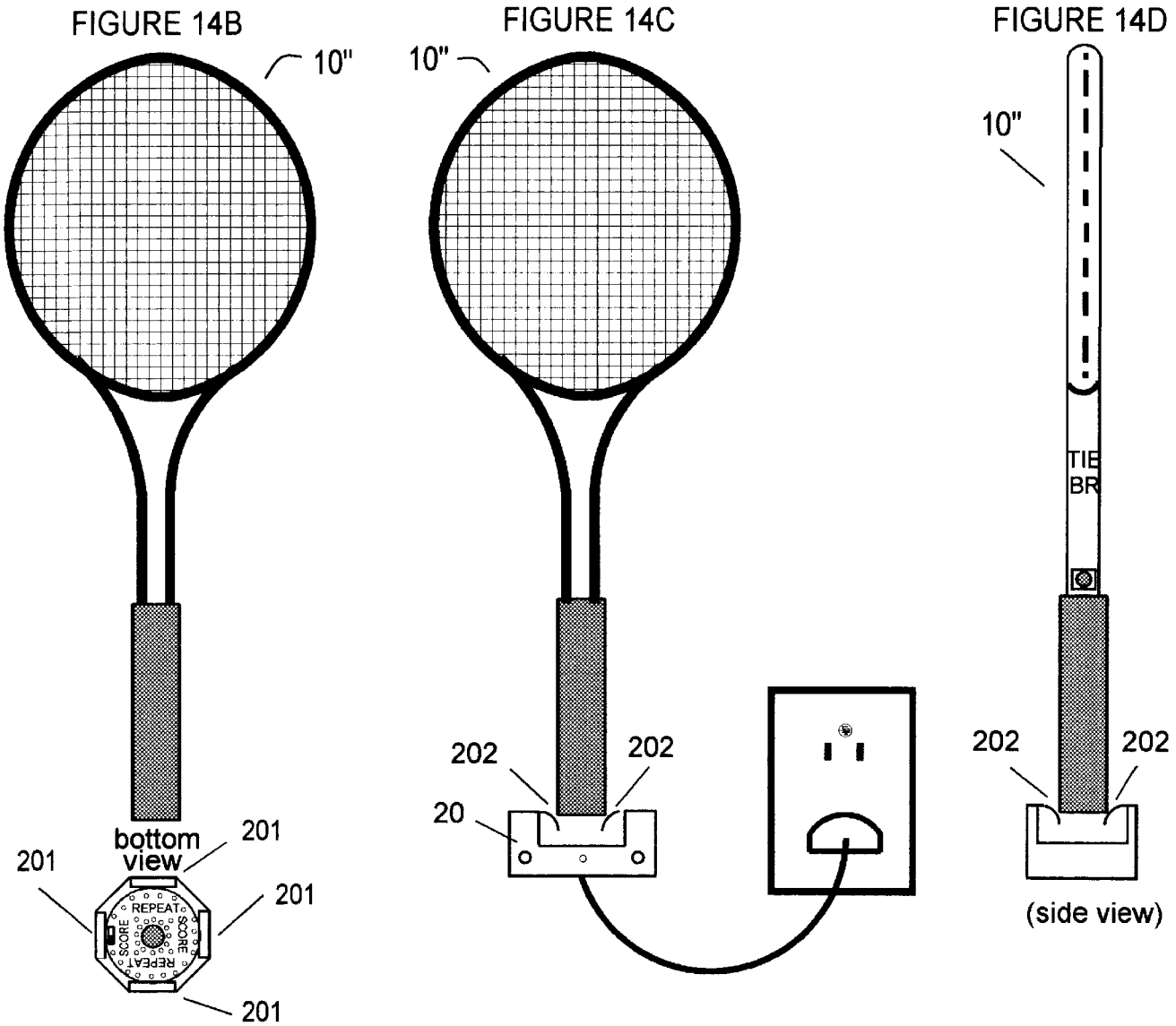
FIG. 14B is a bottom view of the racket with a battery charging mechanism.
FIG. 14C shows the racket of FIG. 14B in charging mode.
FIG. 14D is a side view of the device illustrated in FIG. 14C.

FIGS. 14B–D illustrate the use of an independent charger 20 adapted to recharge the batteries 104 of the rackets 10, 10', 10". If the charger 20 is to be used, contact elements 201 must be included on the racket. The contact elements 201 of the racket provide a means to establish galvanic contact with the contact elements 202 of the charger 20. The charger 20 is powered by an AC source such as a wall outlet. (The charger technology is known in the art.)

The talking rackets with transceivers provided a convenient means for tennis scorekeeping. The rackets are completely self-contained and require no external devices while in use. The talking rackets can be factory ordered with the owner's name pre-recorded. Also, the player's gender can be specified, i.e. a male voice simulator for a male player and a female voice simulator for a female player.

Figure 20:
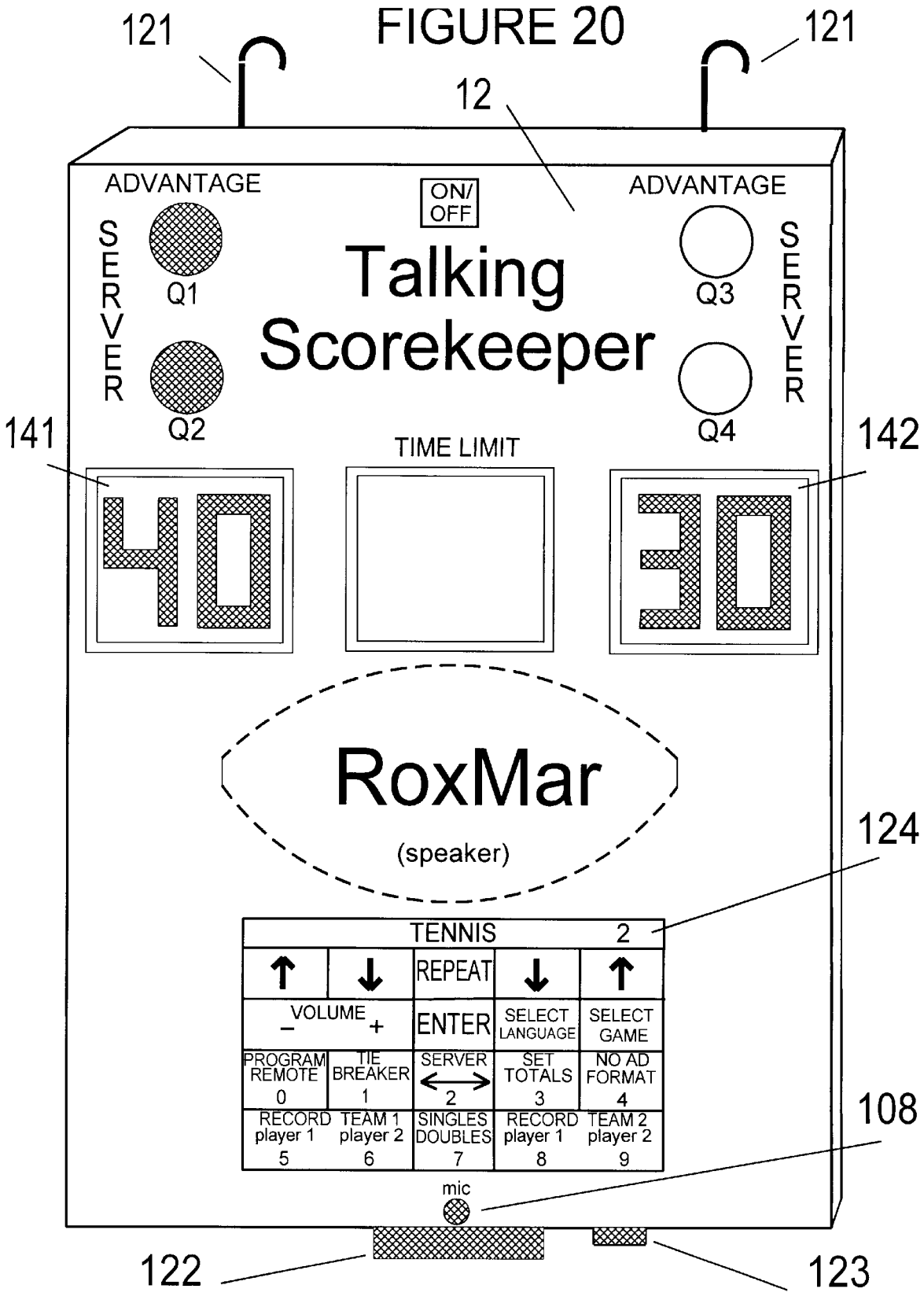
FIG. 20 shows a remote scoreboard of the talking scorekeeper.

FIG. 20 illustrates optional modifications of the talking scoreboard 12. The talking scoreboard 12 includes a first mounting mechanism 121 that allows a user to hang the scoreboard 12 on a fence or wall. The scoreboard 12 also includes a second mounting mechanism 122 that is adapted to receive a tripod or a mounting stake to support the scoreboard 12. The scoreboard 12 may also include a multi-pin plug 123. The plug 123 can be used as a connection for wired remote, an input for an external power source, an output to an external speaker system, a serial data output, or any other connection desired by a user. When the scoreboard 12 is being used in a game where the participants switch sides, the scoreboard will rotate score positions with the players. That is, a first player's score will always be on top or right, regardless of his current side. Similarly, the second player's score will always be on the bottom or left.

Figure 27:
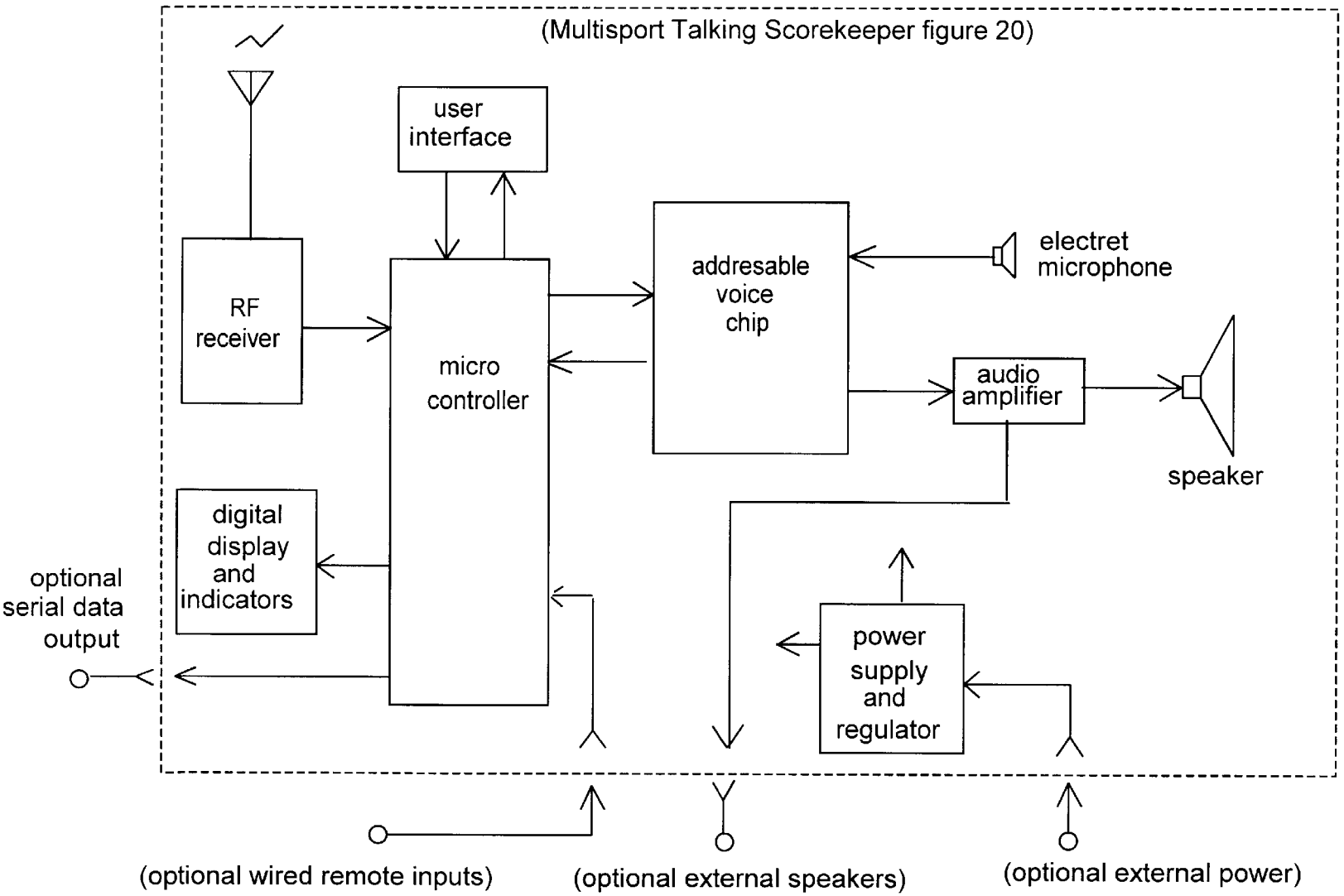
FIG. 27 is a schematic diagram of the scoreboard.

A single talking scoreboard 12 can be used for numerous sports. Since the scoreboard 12 is controlled by a microprocessor as shown in the schematic in FIG. 27, the microprocessor can be programmed to provide scoring functions according to the scoring rules of various sports. A function designation face plate 124 for the 4×5 push button keypad (see FIG. 20A) of the scoreboard can be changed to provide the necessary labelling for whatever sport is chosen. The function designation plate 124 is labelled with the functions that are programmed into the microprocessor of the scoreboard 12. These function are chosen to handle the various scoring situations provided by the subject game.

To choose a given game, the user activates the talking scorekeeper and presses the GAME SELECT button. The user then enters the number of the desired game, as designated on the appropriate face plate.

FIGS. 21–26 illustrate face plates 124 for an assortment of games that can be programmed into the scoring capabilities of the talking scorekeeper of the present invention. In addition to the racket sports described in detail herein, volleyball and basketball are easily accommodated. These games require different remote mechanisms, as are described in detail in the inventor's prior U.S. Pat. No. 5,574,422. It should also be noted that any button that is activated has a related audio cue. This allows the players to be alerted to a scoreboard function without their having to look at the scoreboard.

Figure 32:
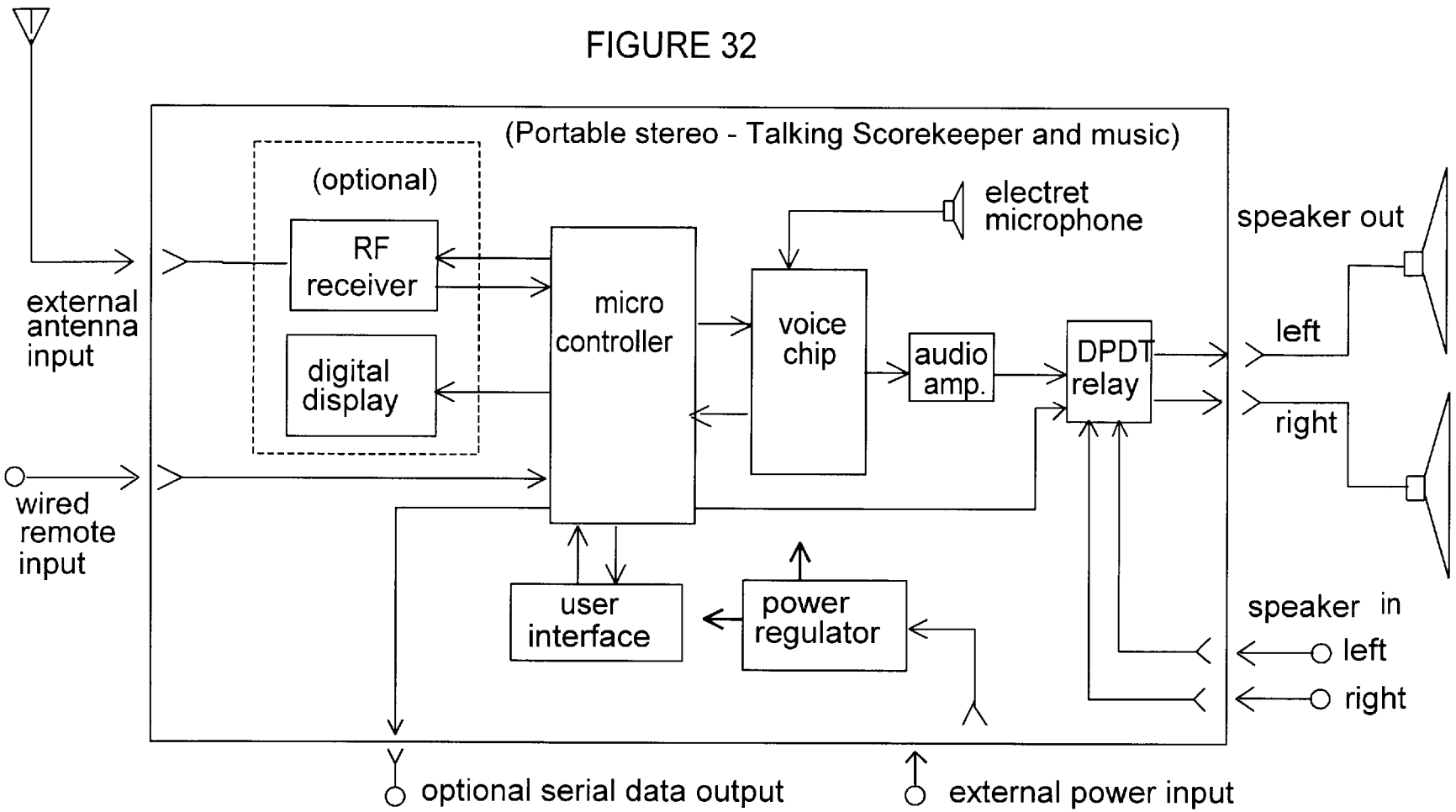
FIG. 32 is a schematic diagram of the scoreboard connected to an external stereo in such a manner as to retain the stereo functions.

FIGS. 29–31 show an adapter 22 that allows the talking scorekeeper to be wired into a portable stereo system 24. The adapter 22 includes a plurality of input/output jacks 221 and connectors 222 that are used to connect to the circuitry of the stereo 24. The appropriate wiring connections are indicated in the schematic shown in FIG. 32. In this wiring configuration, the stereo 24 would be shut off only while the talking scorekeeper announces the score. After the score is announced, the stereo feed would resume through the speakers. The portable stereo 24 must have detachable speakers to accommodate this configuration.

Figure 36:
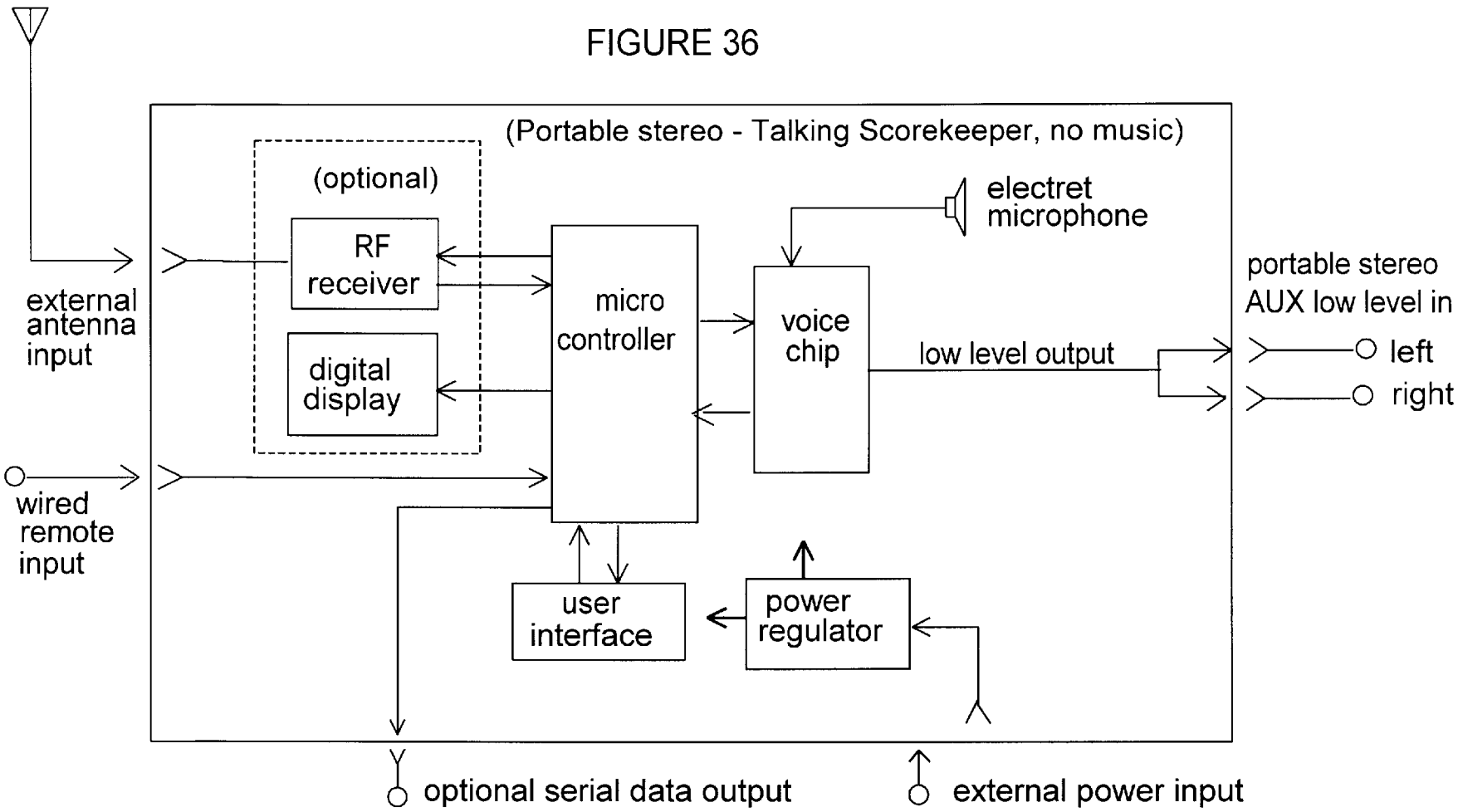
FIG. 36 is a schematic diagram of the scoreboard connected to external speakers.

FIGS. 33–35 show another adapter 22' that allows the talking scorekeeper to be wired into a portable stereo system 24. The adapter 22' would only allow the talking scorekeeper to utilize the amplifier and speakers of the stereo. The stereo feed would be disabled in this configuration. The appropriate wiring for this configuration is shown in the schematic in FIG. 36. This configuration does not require detachable speakers.

Figures 37, 37A:
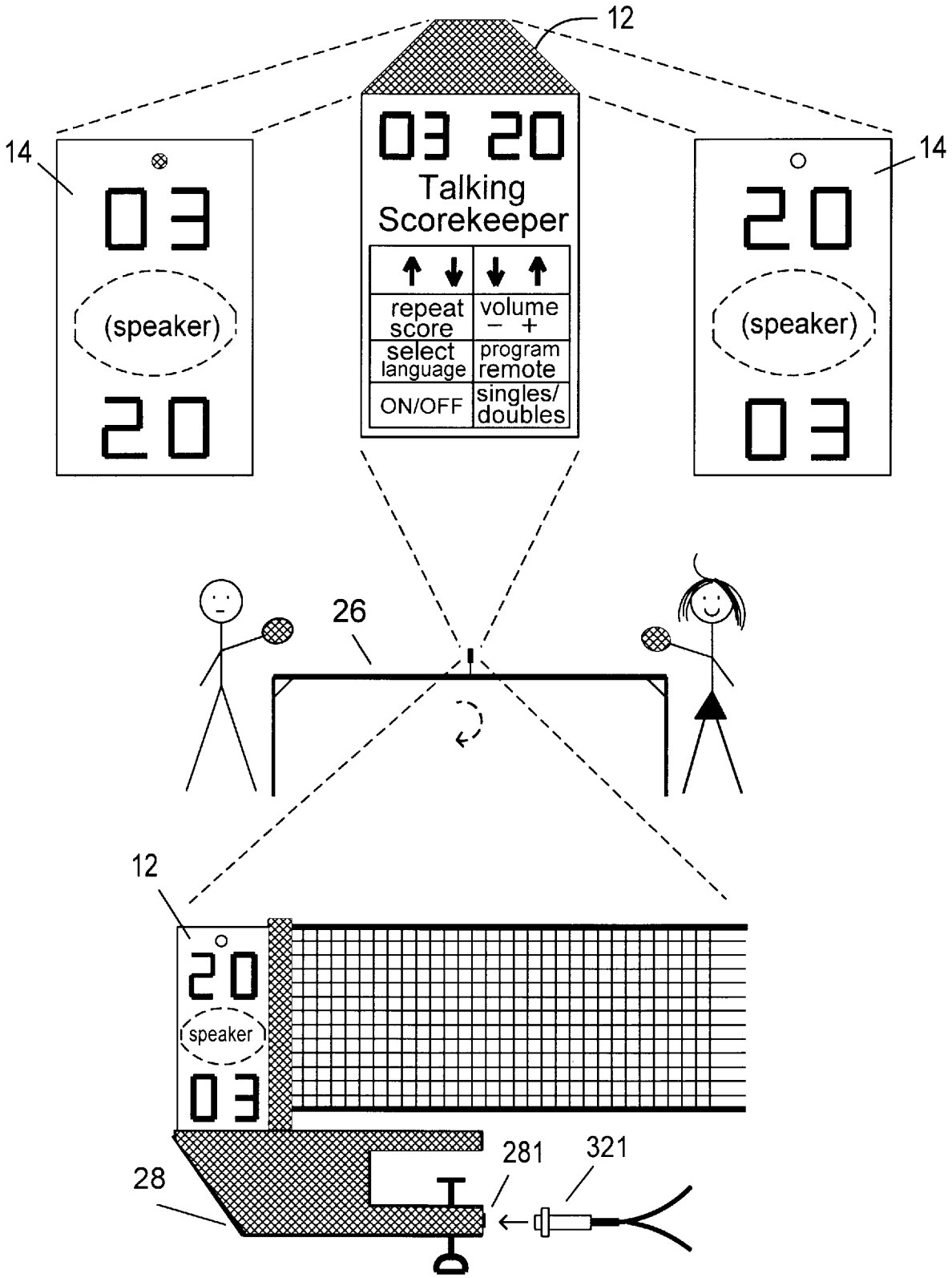
FIG. 37 shows a talking scorekeeper with visual display adapted for ping pong.
FIG. 37A is a detail view of the ping pong scorekeeper net bracket.

FIGS. 37 and 37A show the scoreboard 12 of the talking scorekeeper adapted to be mounted on a ping pong table 26. (FIGS. 38 and 38A show the scoreboard with audio capability only.) In the ping pong adaptation, the scoreboard 12 can be constructed integrally to a net bracket 28. The net bracket 28 includes an input jack 281.

Figure 39:
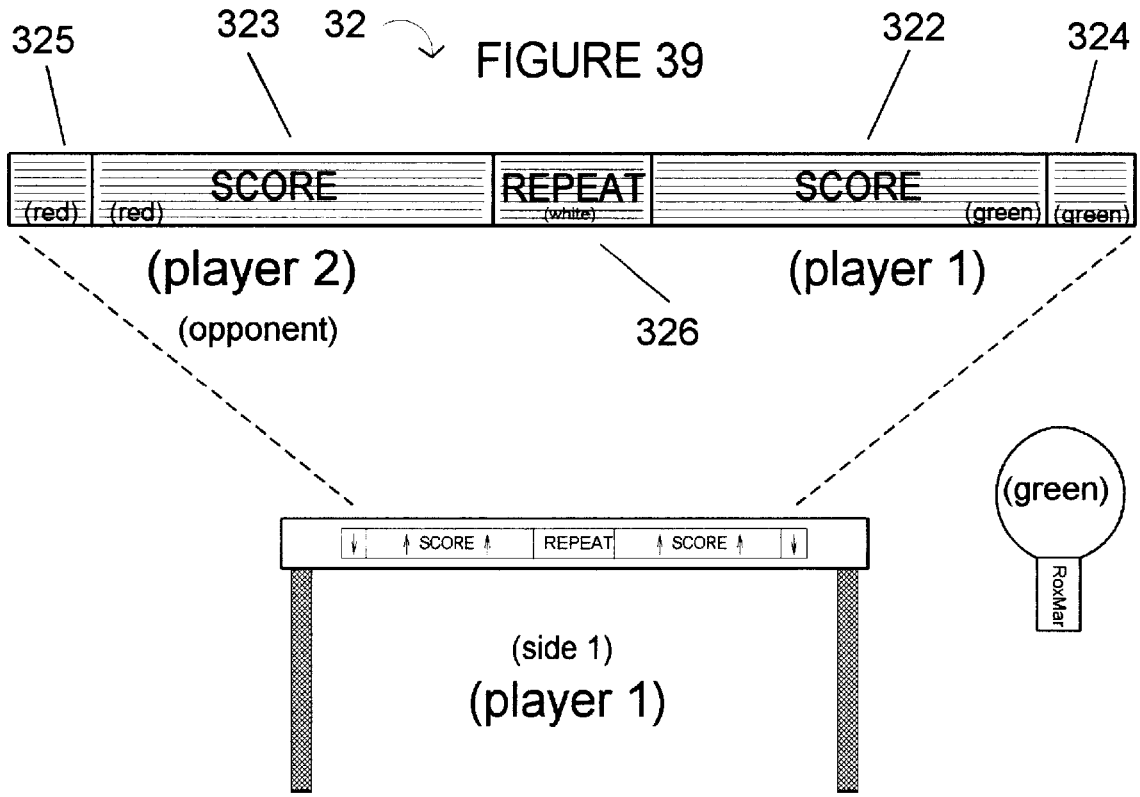
FIG. 39 depicts the first player scoring grid of the ping pong scorekeeper.
Figure 40:
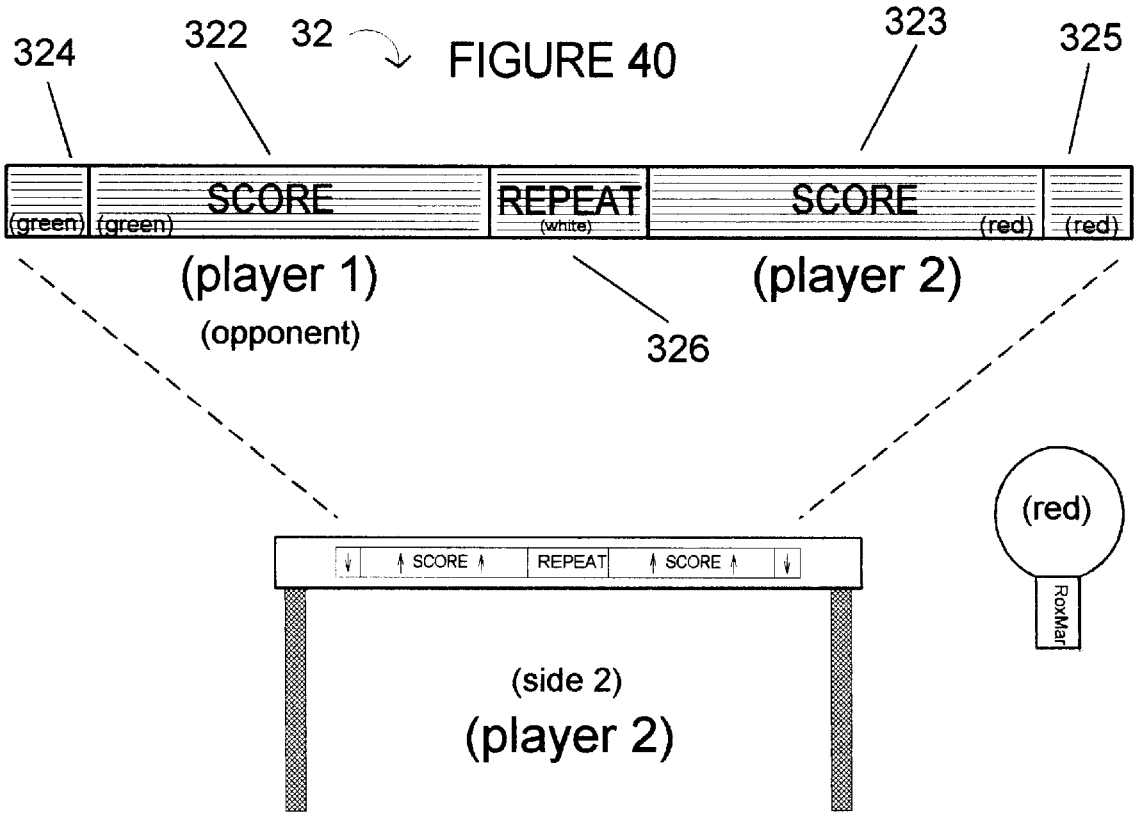
FIG. 40 depicts the second player scoring grid of the ping pong scorekeeper.

As is shown in FIGS. 39 and 40, the talking scorekeeper for ping pong can include a scoring grid 32 embedded in the ends of the ping pong table. The scoring grid includes a first scoring area 322, a second scoring area 323, a first scoring correction area 324, a second scoring correction area 325, and a repeat area 326. To provide the grid with some flexibility to assure solid contacts, the grid 32 is mounted on a cushioning backing, generally foam rubber.

Figure 43:
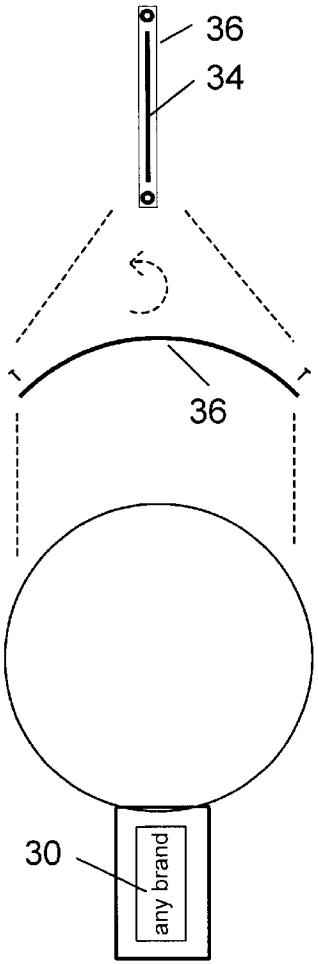
FIG. 43 shows an add-on paddle bridge switch on a ping pong paddle.
Figure 42:
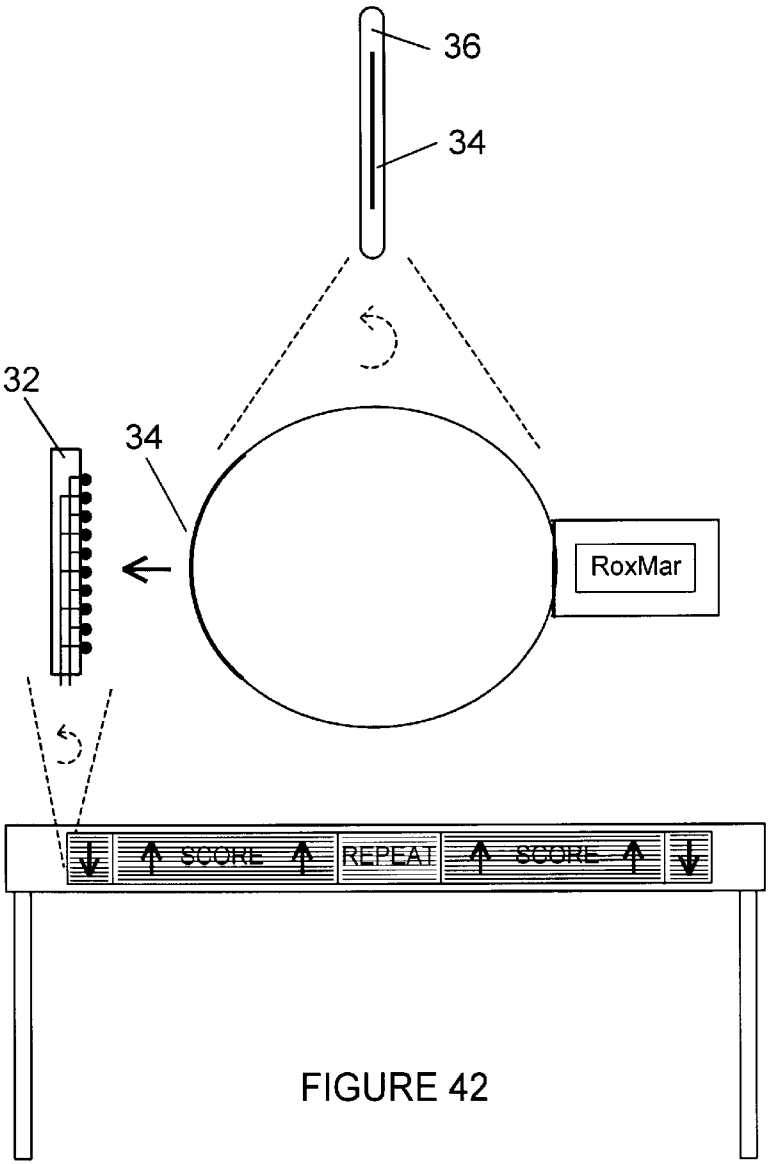
FIG. 42 illustrates how the paddle bridge switch activates the player scoring grid.
Figure 41:
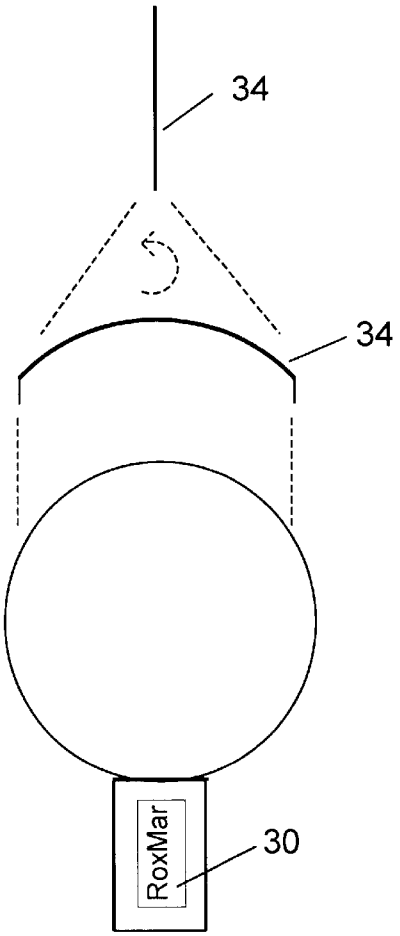
FIG. 41 shows a built-in paddle bridge switch on a ping pong paddle.
Figure 44:
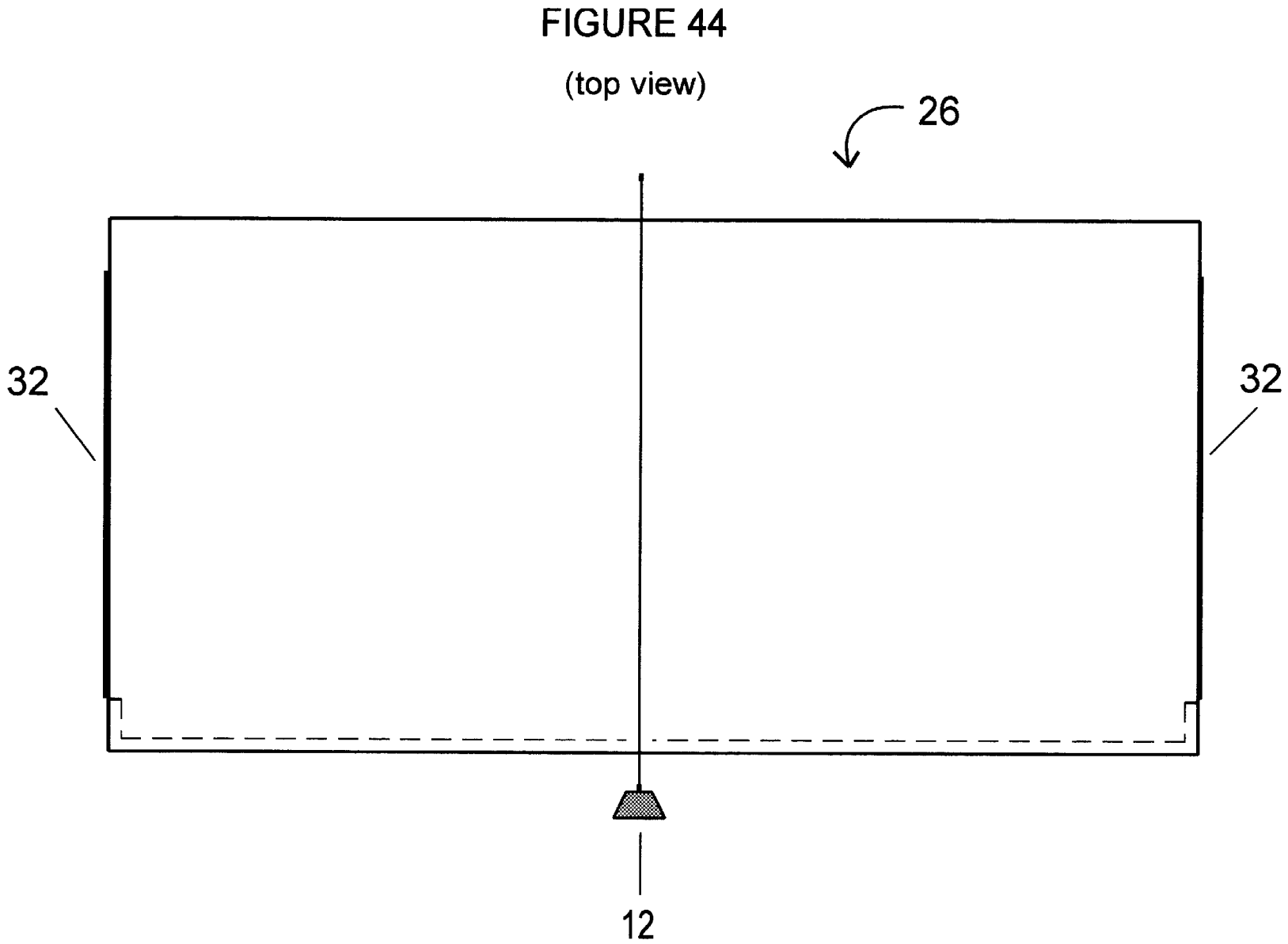
FIG. 44 is an overhead view of the ping pong scorekeeper installed on a ping pong table.
Figure 47:
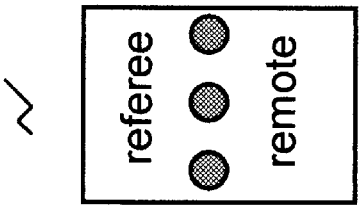
FIG. 47 shows a second alternate remote score control means intended for use by a non-participant.

The scoring grid 32 is activated by a contact mechanism 34. The contact mechanism 34 is an electrically conductive wire that is affixed to the paddle 30. The contact mechanism 34 may be embedded in the paddle 30 itself as shown in FIG. 41. Alternatively, as when adding the mechanism to an existing paddle, the contact mechanism 34 can be affixed to a mounting strip 36 that is in turn affixed to the paddle 30, as shown in FIG. 43. Placing the contact mechanism 34 on the end of the paddle 30 eliminates inadvertent scoring contacts when the face of the paddle 30 strikes the grid 32 during play. To make a conductive contact, the paddle 30 must contact the grid 32 at an approximately 90° angle. Players'bodies contacting the grid will have no effect on the scorekeeper, presuming the players are not wearing conductive clothing.

Figure 48:
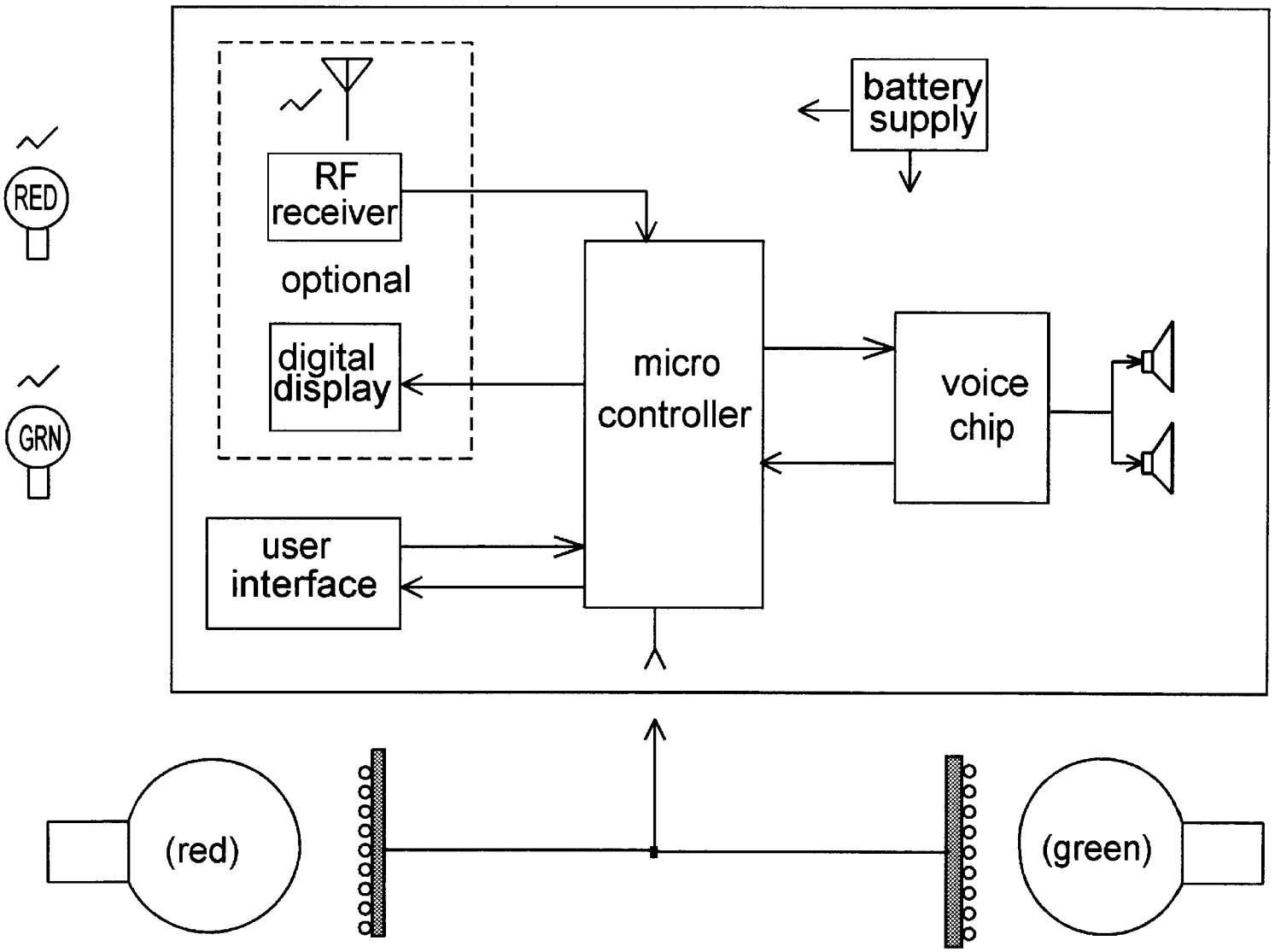
FIG. 48 is a schematic diagram of the ping pong talking scorekeeper.

To increment the score, a player simply uses his paddle 30 to make a connection between any two of the wires of the grid 32 in either the first scoring area 322, or the second scoring area 323, depending upon which player or team has won the point. Making this connection causes the circuitry of the scorekeeper to be activated to update the score. (The circuitry of the ping pong scorekeeper is illustrated in the schematic shown in FIG. 48.) If the score needs to be corrected (decremented), the player uses his paddle to make a connection in the correcting areas 324, 325. To repeat the score or to check the proper server, simply press the paddle against the grid 32 in the repeat area 326.

Figure 46:
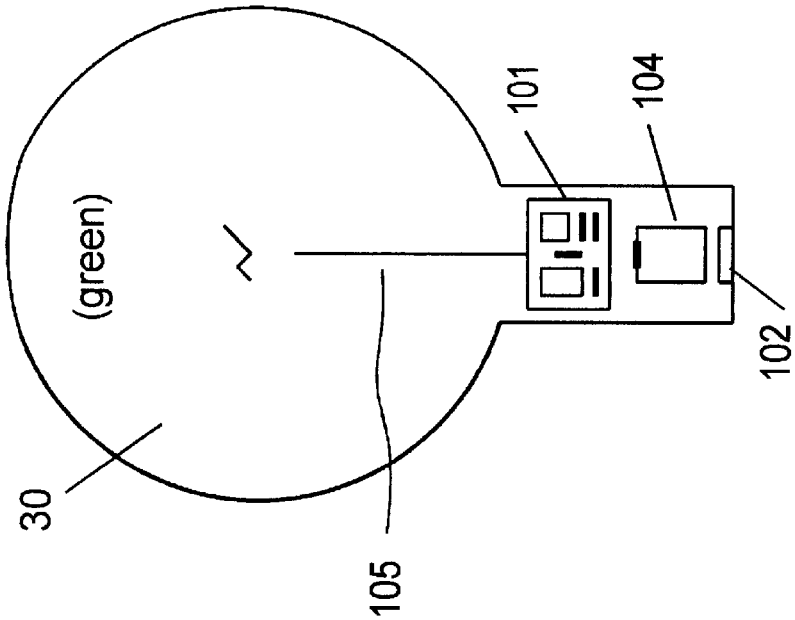
FIG. 46 shows an alternate remote score control means for a second player.
Figure 45:
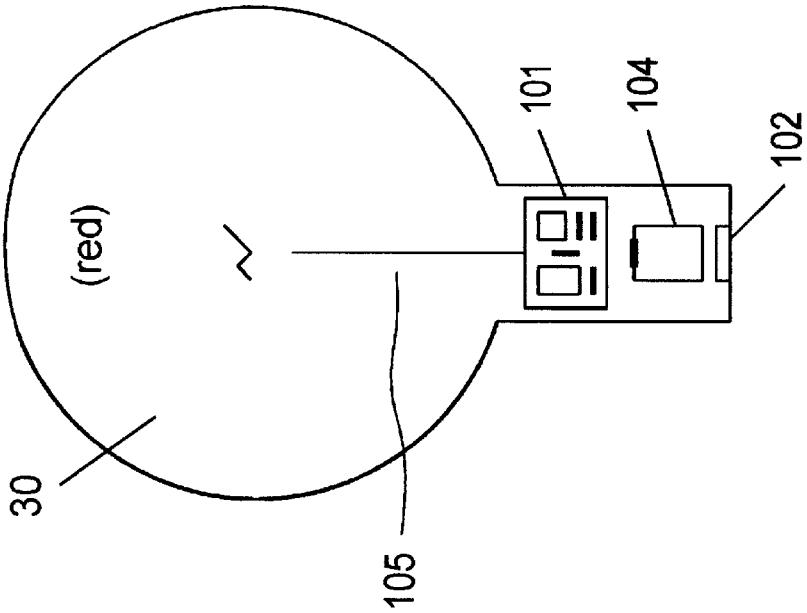
FIG. 45 shows an alternate remote score control means for a first player.

As illustrated in FIGS. 45 and 46, the ping pong paddles 30 can be adapted to contain the transmission means as in the racket 10. For officiated games, a referee remote (described in detail in U.S. Pat. No. 5,574,422) with a red score button, a green score button, and a repeat button can be used to perform the functions of the scoring grid 32.

It is envisioned that the typical deployment of the talking scorekeeper for ping pong will be with the player keeping score using the scoring grid 32. Singles play would be as follows:

After it has been determined who will serve first, that first player presses the first score area 322. The server controls the scorekeeper at all times. The scorekeeper announces "Begin new game, zero serving zero." The voice output used by the scorekeeper is changed from a first voice for the first player serving to a second voice when the second player is serving. The voices alternate after each five points served so as to alternate with the proper server. After each five points, the scorekeeper announces "Rotate serve," followed by the score. The "Rotate serve" announcement precedes the score so that errors in the person serving can be avoided.

To assure that the points are input properly, the scorekeeper emits a short tone immediately preceding announcement of a point won by the server. No tone is emitted for a point won by the receiver. Thus if the server wins the first point, the audio output would be "'tone', one serving zero." If the receiver then wins the second point, the output would be "one serving one." These audio cues allow the non-scorekeeping player to monitor the score without having to avert his visual focus, thereby improving his concentration on the game.

It should be noted that in practice, the grid 32 will be color coded, so that each player's paddle color matches a side of the grid 32. Further, the receiver's scoring grid is disabled during play so that he does not inadvertently input scored points to the scorekeeper while he is not serving.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A scorekeeping device for games comprising:

a microcontroller, an addressable voice chip that an assembler pre-records with audible signals to track and score the games, a user interface including controls that a user operates to input information to said device, said user interface is included in a racket used in a subject game, and at least one score announcing means, said score announcing means announces said score by means of a voice simulator chip; wherein upon activation of a first score button on said user interface, said microcontroller causes an audible warning tone to be sounded before commencement of the game, the microcontroller increments the score following each point and upon activation of a triggering means by a user, said score announcing means thereafter announces an updated score, and said device includes means to manually override said microcontroller to correct a scoring error.

2. The scorekeeping device of claim 1 wherein:

means to visually display the score are included.

3. The scorekeeping device of claim 1 wherein:

means to remotely operate said score announcing means are included in equipment that is utilized in a subject game.

4. The scorekeeping device of claim 1 wherein:

said microcontroller includes scoring algorithms for a plurality of games.

5. The scorekeeping device of claim 1 wherein:

a user controls functions of said device by changing a spatial orientation of said racket.

6. The scorekeeping device of claim 1 wherein:

visual score displays are altered when players change sides during a game so that a score of a given player will always appear in the same position.

7. The scorekeeping device of claim 1 wherein:

adapter means are included to integrate circuitry of said device with speaker and amplifier functions of an independent stereo system.

8. A scorekeeping device for racket games comprising:

a microcontroller, an addressable voice chip that an assembler pre-records with audible signals to track and score the games, a user interface including controls that a user operates to input information to said device, and at least one score announcing means, said score announcing means announces said score by means of a voice simulator chip; wherein upon activation of a first score button on said user interface, said microcontroller causes an audible warning tone to be sounded before commencement of the game, the microcontroller increments the score following each point and upon activation of a triggering means by a user, and said device includes means to manually override said microcontroller to correct a scoring error; and wherein said microcontroller, said voice chip, said user interface, and said score announcing means are included in rackets used in the games, and a first racket used by a first player is in synchronized communication with a second racket used by a second player such that a score of said game is announced simultaneously in both rackets.

9. The scorekeeping device of claim 8 wherein:

a user controls functions of said device by changing a spatial orientation of a racket.

10. The scorekeeping device of claim 8 wherein:

means to visually display the score are included are included.

11. The scorekeeping device of claim 8 wherein:

adapter means are included to integrate circuitry of said device with speaker and amplifier functions of an independent stereo system.

12. A scorekeeping device for ping pong comprising:

a microcontroller, an addressable voice chip that an assembler pre-records with audible signals to track and score games, a scoreboard with both audible score announcing capability, a triggering mechanism that a user operates to input information to said device, and at least one score announcing means, said score announcing means announces said score by means of a voice simulator chip; wherein said triggering mechanism comprises a scoring grid attached to ends of a ping pong table, said scoring grid includes a first scoring area, a second scoring area, a first scoring correction area, a second scoring correction area, and a repeat area, said scoring grid is mounted to said ping pong table by means of a flexible backing, said triggering mechanism further comprises a contact mechanism to activate said scoring grid, said contact mechanism comprises an electrically conductive material that is affixed to an end of a ping pong paddle, wherein said triggering mechanism is activated to announce and track the score by a player making an electrically conductive connection between said contact mechanism and said scoring grid, such that the score of the game is incremented by a player placing his paddle in a position that causes said contact mechanism to make an electrical connection with said scoring grid, said player contacts said first scoring area to increment a first player score, said player contacts a second scoring area to increment a second player score, said player contacts a first player decrement score to decrement said first player score, said player contacts a second player decrement score to decrement said second player score, and said player contacts said repeat area to repeat the score and to determine which player is to serve.

13. The scorekeeping device for ping pong of claim 12 wherein:

said contact mechanism is affixed to said end of said paddle.

14. The scorekeeping device for ping pong of claim 12 wherein:

said contact mechanism is embedded in a contact strip affixed to said end of said paddle.

15. The scorekeeping device for ping pong of claim 12 wherein:

a determination is made as to which player shall be server, said server then presses said first score area, said scorekeeping device announces "Begin new game, zero serving zero", a voice used by the scorekeeping device is changed from a first voice for a first player serving to a second voice for a second player serving, said first and second voices alternate after each five points served so as to alternate with the proper server, after each five points, said scorekeeping device announces "Rotate serve," followed by the score, the "Rotate serve" announcement precedes the score so that errors in the person serving can be avoided, and to assure that points are input properly, said scorekeeping device emits a tone immediately preceding announcement of a point won by the server, no tone is emitted for a point won by a receiver, such that when the server wins the first point, the audio output would be "'tone', one serving zero", and when the receiver wins the second point, the output would be "one serving one".

16. The scorekeeping device for ping pong of claim 12 wherein:

said scoring grid on the receiver's end of said ping pong table is disabled during play so that the receiver does not inadvertently input scored points to said scorekeeping device.

17. The scorekeeping device of claim 12 wherein:

adapter means are included to integrate circuitry of said device with speaker and amplifier functions of an independent stereo system.

* * * * *